US008515106B2

(12) United States Patent
Xiang et al.

(10) Patent No.: US 8,515,106 B2
(45) Date of Patent: Aug. 20, 2013

(54) METHODS AND APPARATUS FOR PROVIDING AN INTERFACE TO A PROCESSING ENGINE THAT UTILIZES INTELLIGENT AUDIO MIXING TECHNIQUES

(75) Inventors: Pei Xiang, San Diego, CA (US); Samir Kumar Gupta, San Diego, CA (US); Eddie L. T. Choy, Carlsbad, CA (US); Prajakt V. Kulkarni, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 1154 days.

(21) Appl. No.: 11/946,319

(22) Filed: Nov. 28, 2007

(65) Prior Publication Data

US 2009/0136063 A1 May 28, 2009

(51) Int. Cl.
*H04R 5/00* (2006.01)
*H04R 5/02* (2006.01)

(52) U.S. Cl.
USPC ..... 381/310; 381/17; 381/306

(58) Field of Classification Search
USPC ..... 381/17, 18, 309, 310, 61, 63, 1, 303, 381/306
See application file for complete search history.

(56) References Cited

U.S. PATENT DOCUMENTS

| | | | | |
|---|---|---|---|---|
| 5,119,422 | A | | 6/1992 | Price |
| 5,199,075 | A | | 3/1993 | Fosgate |
| 5,243,640 | A | | 9/1993 | Hadley et al. |
| 5,301,237 | A | | 4/1994 | Fosgate |
| 5,371,799 | A | | 12/1994 | Lowe et al. |
| 5,412,731 | A | * | 5/1995 | Desper ..... 381/1 |
| 5,436,975 | A | | 7/1995 | Lowe et al. |
| 5,757,927 | A | | 5/1998 | Gerzon et al. |
| 5,809,149 | A | | 9/1998 | Cashion et al. |
| 5,850,455 | A | | 12/1998 | Arnold et al. |
| 6,011,851 | A | | 1/2000 | Connor et al. |
| 6,067,361 | A | | 5/2000 | Kohut et al. |

(Continued)

FOREIGN PATENT DOCUMENTS

| | | |
|---|---|---|
| EP | 0666702 | 8/1995 |
| EP | 0865025 A1 | 9/1998 |

(Continued)

OTHER PUBLICATIONS

International Search Report and Written Opinion—PCT/US2008/084903, International Search Authority—European Patent Office—Jul. 6, 2006.

(Continued)

*Primary Examiner* — Alexander Talpalatski
(74) *Attorney, Agent, or Firm* — Espartaco Diaz Hidalgo

(57) ABSTRACT

A method for providing an interface to a processing engine that utilizes intelligent audio mixing techniques may include receiving a request to change a perceptual location of an audio source within an audio mixture from a current perceptual location relative to a listener to a new perceptual location relative to the listener. The audio mixture may include at least two audio sources. The method may also include generating one or more control signals that are configured to cause the processing engine to change the perceptual location of the audio source from the current perceptual location to the new perceptual location via separate foreground processing and background processing. The method may also include providing the one or more control signals to the processing engine.

36 Claims, 20 Drawing Sheets

(56) References Cited

U.S. PATENT DOCUMENTS

| | | | | |
|---|---|---|---|---|
| 6,154,545 | A | 11/2000 | Kohut et al. | |
| 6,195,434 | B1 | 2/2001 | Cashion et al. | |
| 6,349,223 | B1 | 2/2002 | Chen | |
| 6,421,446 | B1 | 7/2002 | Cashion et al. | |
| 6,504,934 | B1 | 1/2003 | Kasai et al. | |
| 6,611,603 | B1 | 8/2003 | Norris et al. | |
| 6,839,438 | B1 | 1/2005 | Riegelsberger et al. | |
| 6,850,496 | B1 | 2/2005 | Knappe et al. | |
| 6,882,971 | B2 | 4/2005 | Craner | |
| 6,937,737 | B2 | 8/2005 | Polk, Jr. | |
| 6,947,728 | B2 | 9/2005 | Tagawa et al. | |
| 6,959,071 | B2 | 10/2005 | Fujisawa | |
| 6,983,251 | B1 | 1/2006 | Umemoto et al. | |
| 6,985,594 | B1 | 1/2006 | Vaudrey et al. | |
| 7,012,630 | B2 | 3/2006 | Curry et al. | |
| 7,206,413 | B2 | 4/2007 | Eid et al. | |
| 7,433,716 | B2 | 10/2008 | Denton | |
| 7,489,951 | B2 | 2/2009 | Kanamori et al. | |
| 8,041,057 | B2 | 10/2011 | Xiang et al. | |
| 2004/0078104 | A1 | 4/2004 | Nguyen et al. | |
| 2005/0045438 | A1 | 3/2005 | Keller et al. | |
| 2005/0147261 | A1 * | 7/2005 | Yeh | 381/92 |
| 2007/0078543 | A1 | 4/2007 | Wakefield | |
| 2007/0253556 | A1 | 11/2007 | Nakao et al. | |
| 2008/0170703 | A1 | 7/2008 | Zivney | |
| 2009/0136044 | A1 | 5/2009 | Xiang et al. | |

FOREIGN PATENT DOCUMENTS

| | | | |
|---|---|---|---|
| EP | 1657961 | A1 | 5/2006 |
| JP | 61202600 | A | 9/1986 |
| JP | 2086398 | A | 3/1990 |
| JP | 4014920 | A | 1/1992 |
| JP | 5300597 | A | 11/1993 |
| JP | 8046585 | A | 2/1996 |
| JP | 8047100 | A | 2/1996 |
| JP | 8056400 | A | 2/1996 |
| JP | 8107600 | A | 4/1996 |
| JP | 8154300 | A | 6/1996 |
| JP | 09501286 | A | 2/1997 |
| JP | 11215597 | A | 8/1999 |
| JP | 2000197199 | A | 7/2000 |
| JP | 2003330477 | A | 11/2003 |
| JP | 2006005868 | A | 1/2006 |
| JP | 2006074572 | A | 3/2006 |
| JP | 2006174198 | A | 6/2006 |
| JP | 2006238498 | A | 9/2006 |
| JP | 2006254064 | A | 9/2006 |
| JP | 2007228526 | A | 9/2007 |
| RU | 98103499 | | 2/2000 |
| RU | 98121130 | | 9/2000 |
| TW | 200636676 | | 10/2006 |
| TW | 200638338 | | 11/2006 |
| WO | 9504442 | A1 | 2/1995 |
| WO | 9705755 | A1 | 2/1997 |
| WO | 9741711 | A1 | 11/1997 |
| WO | 2007143373 | | 12/2007 |

OTHER PUBLICATIONS

Chowning, J.M.: "The Simulation of Moving Sound Sources," Journal of the Audio Engineering Soecity, Audio Engineering Society, New York, NY, vol. 19, No. 1, pp. 2-06 (Jan. 1, 1971) XP000795995, ISSN: 1549-4950.

Taiwan Search Report—TW097146501—TIPO—Oct. 19, 2012.

* cited by examiner

1084

| | Source stays in foreground (1086) | Source Stays in background (1088) |
|---|---|---|
| foreground left scalar 654 | unity | zero |
| foreground right scalar 656 | unity | zero |
| background left scalar 658 | zero | unity |
| background right scalar 660 | zero | unity |

FIG. 10

METHODS AND APPARATUS FOR PROVIDING AN INTERFACE TO A PROCESSING ENGINE THAT UTILIZES INTELLIGENT AUDIO MIXING TECHNIQUES

CROSS-RELATED APPLICATIONS

This application relates to co-pending application "Methods and Apparatus for Providing a Distinct Perceptual Location for an Audio Source within an Audio Mixture" Ser. No. 11/946,365, co-filed with this application.

TECHNICAL FIELD

The present disclosure relates generally to audio processing. More specifically, the present disclosure relates to processing audio sources in an audio mixture.

BACKGROUND

The term audio processing may refer to the processing of audio signals. Audio signals are electrical signals that represent audio, i.e., sounds that are within the range of human hearing. Audio signals may be either digital or analog.

Many different types of devices may utilize audio processing techniques. Examples of such devices include music players, desktop and laptop computers, workstations, wireless communication devices, wireless mobile devices, radio telephones, direct two-way communication devices, satellite radio devices, intercom devices, radio broadcasting devices, on-board computers used in automobiles, watercraft and aircraft, and a wide variety of other devices.

Many devices, such as the ones just listed, may utilize audio processing techniques for the purpose of delivering audio to users. Users may listen to the audio through audio output devices, such as stereo headphones or speakers. Audio output devices may have multiple output channels. For example, a stereo output device (e.g., stereo headphones) may have two output channels, a left output channel and a right output channel.

Under some circumstances, multiple audio signals may be summed together. The result of this summation may be referred to as an audio mixture. The audio signals before the summation occurs may be referred to as audio sources. As mentioned above, the present disclosure relates generally to audio processing, and more specifically, to processing audio sources in an audio mixture.

BRIEF DESCRIPTION OF THE DRAWINGS

FIGS. 9A, 9B, and 10 illustrate examples of possible values for the foreground attenuation scalars and background attenuation scalars in the audio source processor of FIG. 6;

DETAILED DESCRIPTION

Figure 1:
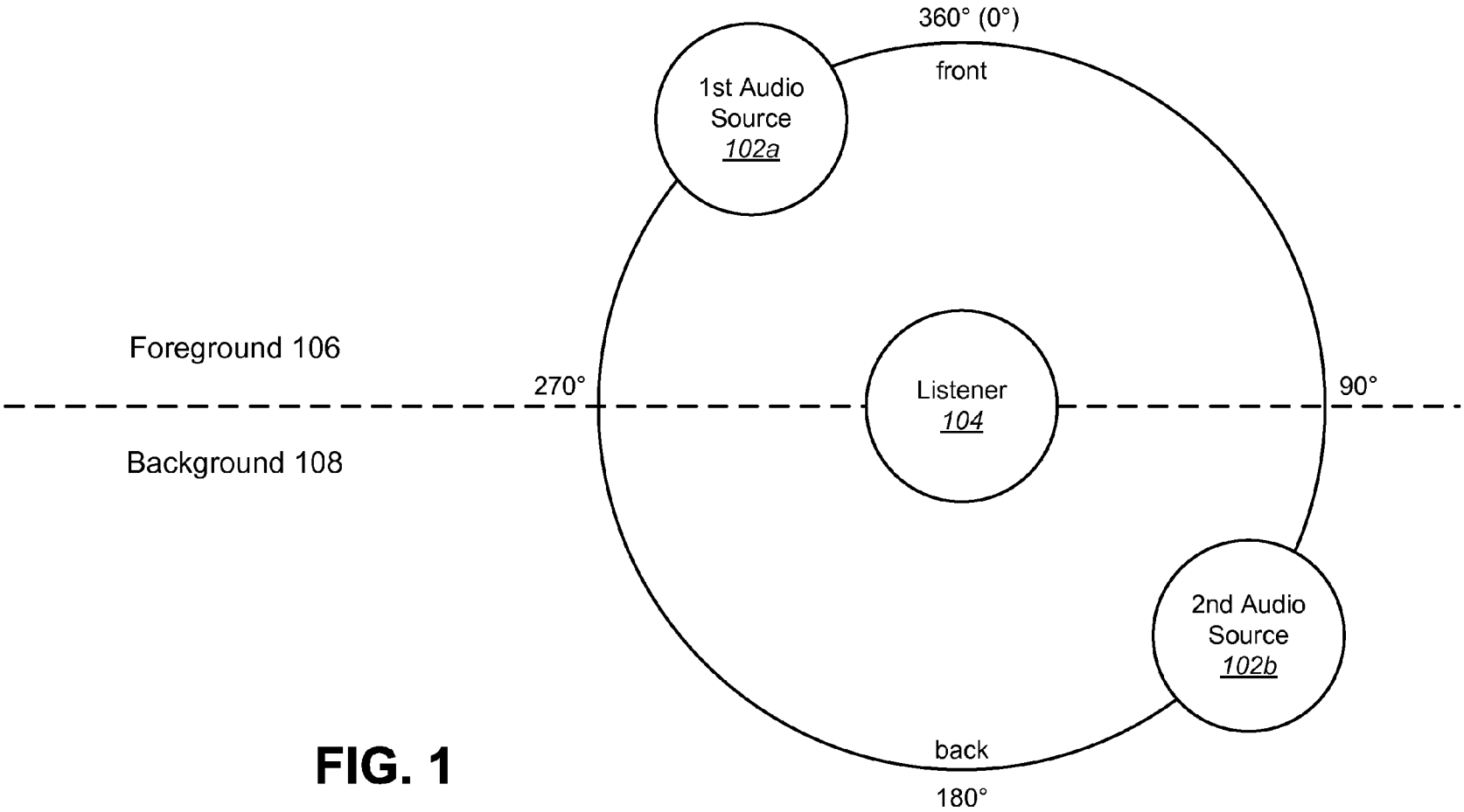
FIG. 1 illustrates an example showing two audio sources that have distinct perceptual locations relative to a listener.

A method for providing an interface to a processing engine that utilizes intelligent audio mixing techniques is disclosed. The method may include triggering by an event a request to change a perceptual location of an audio source within an audio mixture from a current perceptual location relative to a listener to a new perceptual location relative to the listener. The audio mixture may include at least two audio sources. The method may also include generating one or more control signals that are configured to cause the processing engine to change the perceptual location of the audio source from the current perceptual location to the new perceptual location via separate foreground processing and background processing. The method may also include providing the one or more control signals to the processing engine.

An apparatus for providing an interface to a processing engine that utilizes intelligent audio mixing techniques is also disclosed. The apparatus includes a processor and memory in electronic communication with the processor. Instructions are stored in the memory. The instructions may be executable to trigger by an event a request to change a perceptual location of an audio source within an audio mixture from a current perceptual location relative to a listener to a new perceptual location relative to the listener. The audio mixture may include at least two audio sources. The instructions may also be executable to generate one or more control signals that are configured to cause the processing engine to change the perceptual location of the audio source from the current perceptual location to the new perceptual location via separate foreground processing and background processing. The instructions may also be executable to provide the one or more control signals to the processing engine.

A computer-readable medium is also disclosed. The computer-readable medium may include instructions providing an interface to a processing engine that utilizes audio mixing techniques on a mobile device. When executed by a processor, the instructions may cause the processor to trigger by an event a request to change a perceptual location of an audio source within an audio mixture from a current perceptual location relative to a listener to a new perceptual location relative to the listener. The audio mixture may include at least two audio sources. The instructions may also cause the processor to generate one or more control signals that are configured to cause the processing engine to change the perceptual location of the audio source from the current perceptual location to the new perceptual location via separate foreground processing and background processing. The instructions may also cause the processor to provide the one or more control signals to the processing engine.

An apparatus for providing an interface to a processing engine that utilizes intelligent audio mixing techniques is also disclosed. The apparatus may include means for triggering by event a request to change a perceptual location of an audio source within an audio mixture from a current perceptual location relative to a listener to a new perceptual location relative to the listener. The audio mixture may include at least two audio sources. The apparatus may also include means for generating one or more control signals that are configured to cause the processing engine to change the perceptual location of the audio source from the current perceptual location to the new perceptual location via separate foreground processing and background processing. The apparatus may also include means for providing the one or more control signals to the processing engine.

The present disclosure relates to intelligent audio mixing techniques. More specifically, the present disclosure relates to techniques for providing the audio sources within an audio mixture with distinct perceptual locations, so that a listener may be better able to distinguish between the different audio sources while listening to the audio mixture. To take a simple example, a first audio source may be provided with a perceptual location that is in front of the listener, while a second audio source may be provided with a perceptual location that is behind the listener. Thus, the listener may perceive the first audio source as coming from a location that is in front of him/her, while the listener may perceive the second audio source as coming from a location that is in back of him/her. In addition to providing ways for listeners to distinguish between locations in the front and back, different audio sources may also be provided with different angles, or degrees of skew. For example, a first audio source may be provided with a perceptual location that is in front of the listener and to the left, while a second audio source may be provided with a perceptual location that is in front of the listener and to the right. Providing the different audio sources in an audio mixture with different perceptual locations may help the user to better distinguish between the audio sources.

There are many situations in which the techniques described herein may be utilized. One example is when a user of a wireless communication device is listening to music on the wireless communication device when the user receives a phone call. It may be desirable for the user to continue listening to the music during the phone call, without the music interfering with the phone call. Another example is when a user is participating in an instant messaging (IM) conversation on a computer while listening to music or to another type of audio program. It may be desirable for the user to be able to hear the sounds that are played by the IM client while still listening to the music or audio program. Of course, there are many other examples that may be relevant to the present disclosure. The techniques described herein may be applied to any situation in which it may be desirable for a user to be able to perceptually distinguish between the audio sources within an audio mixture.

As indicated above, under some circumstances multiple audio signals may be summed together. The result of this summation may be referred to as an audio mixture. The audio signals before the summation occurs may be referred to as audio sources.

Audio sources may be broadband audio signals, and may have multiple frequency components with frequency analysis. As used herein, the term "mixing" refers to combining the time domain value (either analog or digital) of two audio sources with addition.

FIG. 1 illustrates an example showing two audio sources 102*a*, 102*b* that have distinct perceptual locations relative to a listener 104. The two audio sources 102*a*, 102*b* may be part of an audio mixture that the listener 104 is listening to. The perceptual location of the first audio source 102*a* is shown as being in a foreground region 106, and to the left of the listener 104. In other words, while listening to the audio mixture, the listener 104 may perceive the first audio source 102*a* as being in front of him/her, and to his/her left. The perceptual location of the second audio source 102*b* is shown as being in a background region 108, to the right of the listener 104. In other words, while listening to the audio mixture, the listener 104 may perceive the second audio source 102*b* as being behind him/her, and to his/her right.

FIG. 1 also illustrates how the perceptual location of an audio source 102 may be measured by a parameter that may be referred to herein as a perceptual azimuth angle, or simply as a perceptual angle. As shown in FIG. 1, perceptual angles may be defined so that a perceptual angle of 0° corresponds to a perceptual location that is directly in front of the listener 104. Additionally, perceptual angles may be defined so as to increase in a clockwise direction, up to a maximum value of 360° (which corresponds to 0°). In accordance with this definition, the perceptual angle of the first audio source 102*a* shown in FIG. 1 is between 270° and 360° (0°), and the perceptual angle of the second audio source 102*b* shown in FIG. 1 is between 90° and 180°. The perceptual location of an audio source 102 that has a perceptual angle between 270° and 360° (0°) or between 0° and 90° is in the foreground region 106, while the perceptual location of an audio source 102 that has a perceptual angle between 90° and 270° is in the background region 108.

The definition of a perceptual angle that was just described will be used throughout the present disclosure. However, perceptual angles may be defined differently and still be consistent with the present disclosure.

The terms "foreground region" and "background region" should not be limited to the specific foreground region 106 and background region 108 shown in FIG. 1. Rather, the term "foreground region" should be interpreted as referring generally to an area that is in front of the listener 104, whereas the term "background region" should be interpreted as referring generally to an area that is in back of the listener 104. For example, in FIG. 1 the foreground region 106 and the background region 108 are both shown as being 180°. Alternatively, however, the foreground region 106 may be greater than 180° and the background region 108 may be less than 180°. Alternatively still, the foreground region 106 may be less than 180° and the background region 108 may be greater than 180°. Alternatively still, both the foreground region 106 and the background region 108 may be less than 180°.

Figure 2:
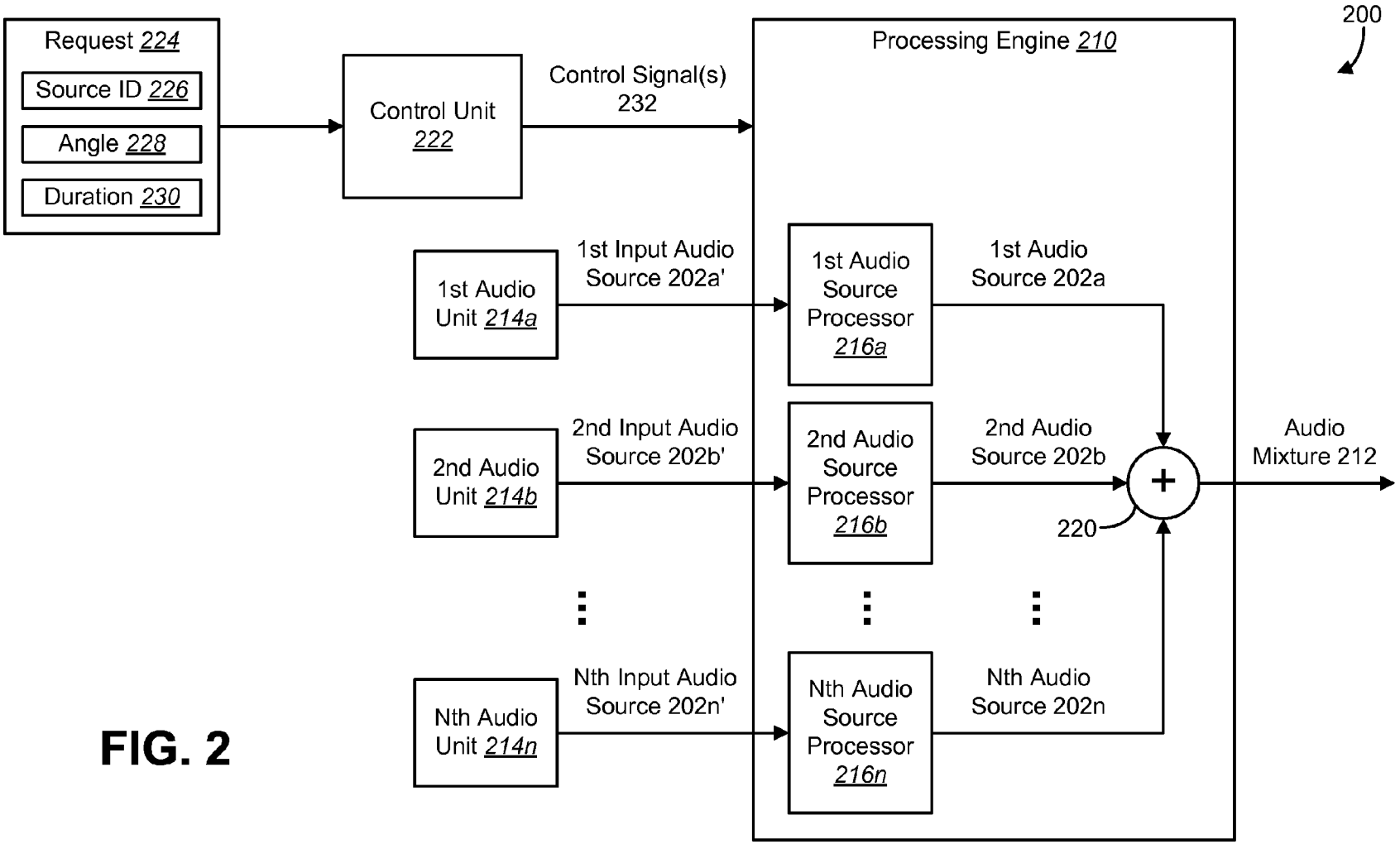
FIG. 2 illustrates an apparatus that facilitates the perceptual differentiation of multiple audio sources.

FIG. 2 illustrates an apparatus 200 that facilitates the perceptual differentiation of multiple audio sources 202. The apparatus 200 includes a processing engine 210. The processing engine 210 is shown receiving multiple audio sources 202' as input. A first input audio source 202*a*' from a first audio unit 214*a*, a second input audio source 202*b*' from a second audio unit 214*b*, and an Nth input audio source 202*n*' from an Nth audio unit 214*n* are shown in FIG. 2. The processing engine 210 is shown outputting an audio mixture 212. A listener 104 may listen to the audio mixture 212 through audio output devices such as stereo headphones.

The processing engine 210 may be configured to utilize intelligent audio mixing techniques. The processing engine 210 is also shown with several audio source processors 216. Each audio source processor 216 may be configured to process an input audio source 202', and to output an audio source 202 that includes a distinct perceptual location relative to the listener 104. In particular, the processing engine 210 is shown with a first audio source processor 216*a* that processes the first input audio source 202*a*', and that outputs a first audio source 202*a* that includes a distinct perceptual location relative to the listener 104. The processing engine 210 is also shown with a second audio source processor 216*b* that processes the second input audio source 202*b*', and that outputs a second audio source 202*b* that includes a distinct perceptual location relative to the listener 104. The processing engine 210 is also shown with an Nth audio source processor 216*n* that processes the Nth input audio source 202*n*', and that outputs an Nth audio source 202*n* that includes a distinct perceptual location relative to the listener 104. An adder 220 may combine the audio sources 202 into the audio mixture 212 that is output by the processing engine 210.

Each of the audio source processors 216 may be configured to utilize methods that are described in the present disclosure for providing an audio source 202 with a distinct perceptual location relative to a listener 104. Alternatively, the audio source processors 216 may be configured to utilize other methods for providing an audio source 202 with a distinct perceptual location relative to a listener 104. For example, the audio source processors 216 may be configured to utilize methods that are based on head related transfer functions (HRTFs).

The apparatus 200 shown in FIG. 2 also includes a control unit 222. The control unit 222 may be configured to provide an interface to the processing engine 210. For example, the control unit 222 may be configured so that a requesting entity may change the perceptual location of one or more of the audio sources 202 via the control unit 222.

FIG. 2 shows the control unit 222 receiving a request 224 to change the perceptual location of one of the audio sources 202 to a new perceptual location. The request 224 may be triggered by an event such as a user pressing a button, an incoming call being received, a program being started or terminated, etc. The request 224 includes an identifier 226 that identifies a particular audio source 202 that is to have its perceptual location changed. The request 224 also indicates the new perceptual location of the audio source 202. In particular, the request 224 includes an indication 228 of the perceptual angle corresponding to the new perceptual location of the audio source 202. The request 224 also includes an indication 230 of the desired duration for transitioning to the new perceptual location.

In response to receiving the request 224, the control unit 222 may generate one or more control signals 232 to provide to the processing engine 210. The control signal(s) 232 may be configured to cause the processing engine 210 to change the perceptual location of the applicable audio source 202 from its current perceptual location to the new perceptual location that is specified in the request 224. The control unit 222 may provide the control signal(s) 232 to the processing engine 210. In response to receiving the control signal(s) 232, the processing engine 210 (and more specifically, the applicable audio source processor 216) may change the perceptual location of the applicable audio source 202 from its current perceptual location to the new perceptual location that is specified in the request 224.

In one possible implementation, the control unit 222 may be an ARM processor, and the processing engine 210 may be a digital signal processor (DSP). With such an implementation, the control signals 232 may be control commands that the ARM processor sends to the DSP.

Alternatively, the control unit 222 may be an application programming interface (API). The processing engine 210 may be a software component (e.g., an application, module, routine, subroutine, procedure, function, etc.) that is being executed by a processor. With such an implementation, the request 224 may come from a software component (either the software component that serves as the processing engine 210 or another software component). The software component that sends the request 224 may be part of a user interface.

In some implementations, the processing engine 210 and/or the control unit 222 may be implemented within a mobile device. Some examples of mobile devices include cellular telephones, personal digital assistants (PDAs), laptop computers, smartphones, portable media players, handheld game consoles, etc.

Figure 2A:
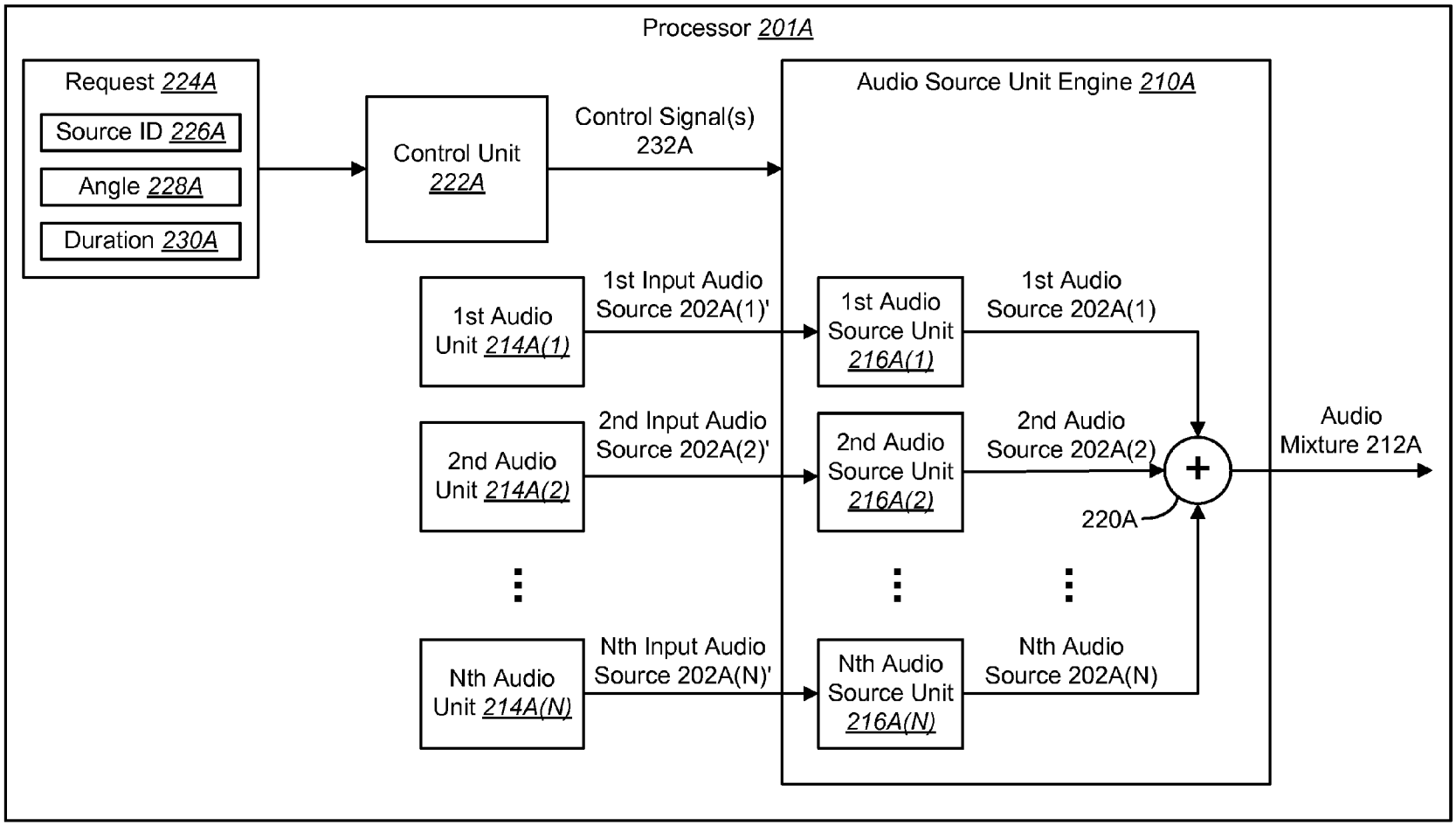
FIG. 2A illustrates a processor that facilitates the perceptual differentiation of multiple audio sources.

FIG. 2A illustrates a processor 201A that facilitates the perceptual differentiation of multiple audio sources 202A. The processor 201A includes an audio source unit engine 210A. The audio source unit engine 210A is shown receiving multiple audio sources 202A' as input. In particular, a first input audio source 202A(1)' from a first audio unit 214A(1), a second input audio source 202A(2)' from a second audio unit 214A(2), and an Nth input audio source 202A(N)' from an Nth audio unit 214A(N) are shown in FIG. 2A. The audio source unit engine 210A is shown outputting an audio mixture 212A. A listener 104 may listen to the audio mixture 212A through audio output devices such as stereo headphones.

The audio source unit engine 210A may be configured to utilize intelligent audio mixing techniques. The audio source unit engine 210A is also shown with several audio source units 216A. Each audio source unit 216A may be configured to process an input audio source 202A', and to output an audio source 202A that includes a distinct perceptual location relative to the listener 104. In particular, the audio source unit engine 210A is shown with a first audio source unit 216A(1) that processes the first input audio source 202A(1)', and that outputs a first audio source 202A(1) that includes a distinct perceptual location relative to the listener 104. The audio source unit engine 210A is also shown with a second audio source unit 216A(2) that processes the second input audio source 202A(2)', and that outputs a second audio source 202A (2) that includes a distinct perceptual location relative to the listener 104. The audio source unit engine 210A is also shown with an Nth audio source unit 216A(N) that processes the Nth input audio source 202A(N)', and that outputs an Nth audio source 202A(N) that includes a distinct perceptual location relative to the listener 104. An adder 220A may combine the audio sources 202A into the audio mixture 212A that is output by the audio source unit engine 210A.

Each of the audio source units 216 may be configured to utilize methods that are described in the present disclosure for providing an audio source 202A with a distinct perceptual location relative to a listener 104. Alternatively, the audio source units 216A may be configured to utilize other methods for providing an audio source 202A with a distinct perceptual location relative to a listener 104. For example, the audio source units 216A may be configured to utilize methods that are based on head related transfer functions (HRTFs).

The processor 201A shown in FIG. 2A also includes a control unit 222A. The control unit 222A may be configured to provide an interface to the audio source unit engine 210A. For example, the control unit 222A may be configured so that a requesting entity may change the perceptual location of one or more of the audio sources 202A via the control unit 222A.

FIG. 2A shows the control unit 222A receiving a request 224A to change the perceptual location of one of the audio sources 202A to a new perceptual location. The request 224A includes an identifier 226A that identifies a particular audio source 202A that is to have its perceptual location changed. The request 224A also indicates the new perceptual location of the audio source 202A. In particular, the request 224A includes an indication 228A of the perceptual angle corresponding to the new perceptual location of the audio source 202A. The request 224A also includes an indication 230A of the desired duration for transitioning to the new perceptual location.

In response to receiving the request 224A, the control unit 222A may generate one or more control signals 232A to provide to the audio source unit engine 210A. The control signal(s) 232A may be configured to cause the audio source unit engine 210A to change the perceptual location of the applicable audio source 202A from its current perceptual location to the new perceptual location that is specified in the request 224A. The control unit 222A may provide the control signal(s) 232A to the audio source unit engine 210A. In response to receiving the control signal(s) 232A, the audio source unit engine 210A (and more specifically, the applicable audio source unit 216A) may change the perceptual location of the applicable audio source 202A from its current perceptual location to the new perceptual location that is specified in the request 224A.

Figure 3:
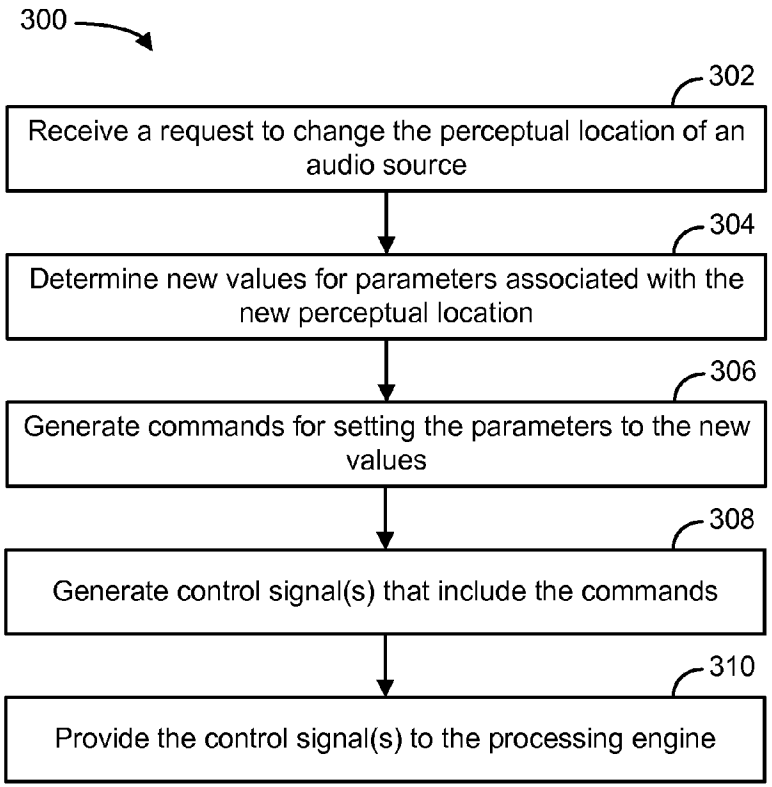
FIG. 3 illustrates a method for providing an interface to a processing engine that utilizes intelligent audio mixing techniques.

FIG. 3 illustrates a method 300 for providing an interface to a processing engine 210 that utilizes intelligent audio mixing techniques. The illustrated method 300 may be performed by the control unit 222 in the apparatus 200 shown in FIG. 2.

In accordance with the method 300, a request 224 to change the perceptual location of an audio source 202 may be received 302. Values of parameters of the processing engine 210 that are associated with the new perceptual location may be determined 304. Commands may be generated 306 for setting the parameters to the new values. Control signal(s) 232 may be generated 308. The control signal(s) 232 may include the commands for setting the parameters to the new values, and thus the control signal(s) 232 may be configured to cause the processing engine 210 to change the perceptual location of the audio source 202 from its current perceptual location to the new perceptual location that is specified in the request 224. The control signal(s) 232 may be provided 310 to the processing engine 210. In response to receiving the control signal(s) 232, the processing engine 210 may change the perceptual location of the audio source 202 to the new perceptual location.

Figure 4:
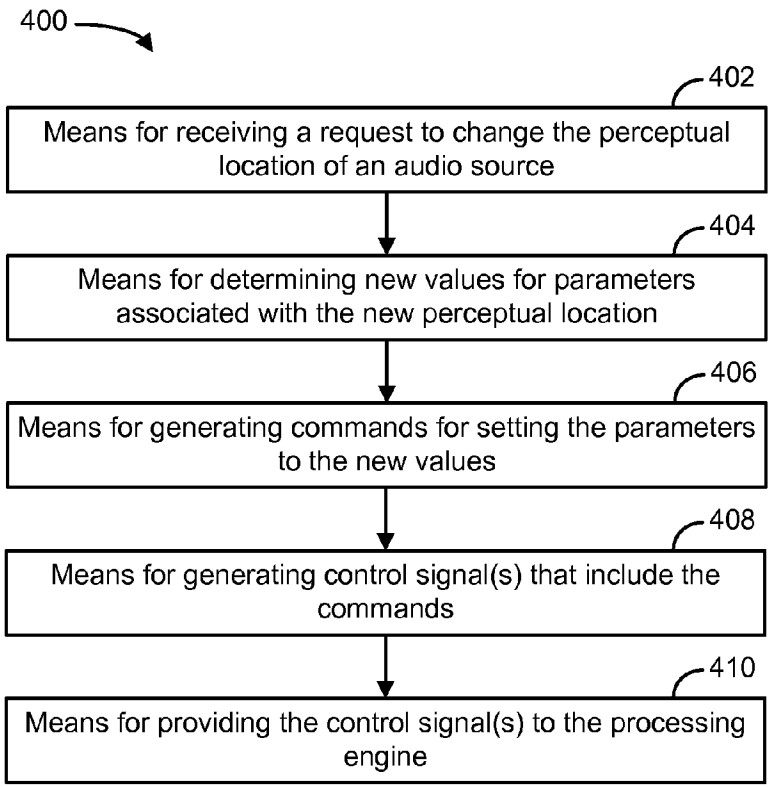
FIG. 4 illustrates means-plus-function blocks corresponding to the method shown in FIG. 3.

The method of FIG. 3 described above may be performed by corresponding means-plus-function blocks illustrated in FIG. 4. In other words, blocks 302 through 310 illustrated in FIG. 3 correspond to means-plus-function blocks 402 through 410 illustrated in FIG. 4.

Figure 5:
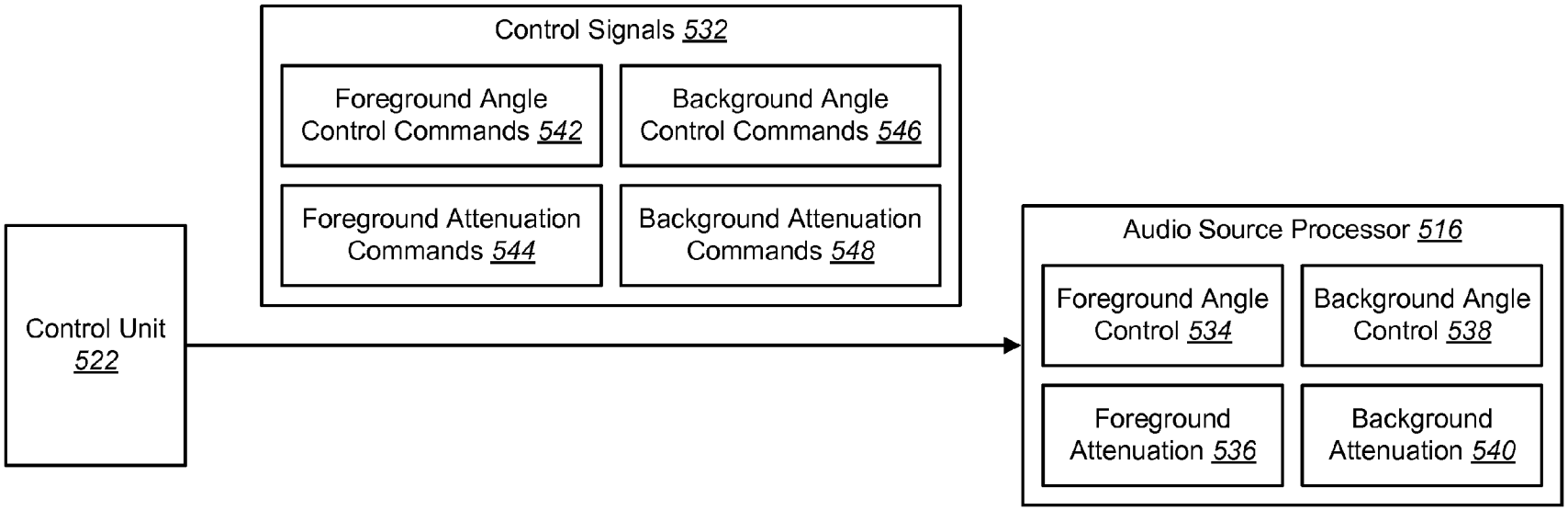
FIG. 5 illustrates an audio source processor that may be utilized in the apparatus shown in FIG. 2.

FIG. 5 illustrates an audio source processor 516 that may be utilized in the apparatus 200 shown in FIG. 2. The audio source processor 516 may be configured to change the perceptual location of an audio source 202 within an audio mixture 212. This may be accomplished by separate foreground processing and background processing of an incoming input audio source 202'. More specifically, the audio source processor 516 may split an incoming input audio source 202' into two signals, a foreground signal and a background signal. The foreground signal and the background signal may then be processed separately. In other words, there may be at least one difference between the way that the foreground signal is processed as compared to the way that the background signal is processed.

The audio source processor 516 is shown with a foreground angle control component 534 and a foreground attenuation component 536 for processing the foreground signal. The audio source processor 516 is also shown with a background angle control component 538 and a background attenuation component 540 for processing the background signal.

The foreground angle control component 534 may be configured to process the foreground signal so that the foreground signal includes a perceptual angle within the foreground region 106. This perceptual angle may be referred to as a foreground perceptual angle. The foreground attenuation component 536 may be configured to process the foreground signal in order to provide a desired level of attenuation for the foreground signal.

The background angle control component 538 may be configured to process the background signal so that the background signal includes a perceptual angle within the background region 108. This perceptual angle may be referred to as a background perceptual angle. The background attenuation component 540 may be configured to process the background signal in order to provide a desired level of attenuation for the background signal.

The foreground angle control component 534, foreground attenuation component 536, background angle control component 538, and background attenuation component 540 may function together to provide a perceptual location for an audio source 202. For example, to provide a perceptual location that is within the foreground region 106, the background attenuation component 540 may be configured to attenuate the background signal, while the foreground attenuation component 536 may be configured to allow the foreground signal to pass without being attenuated. The foreground angle control component 534 may be configured to provide the appropriate perceptual angle within the foreground region 106. Conversely, to provide a perceptual location that is within the background region 108, the foreground attenuation component 536 may be configured to attenuate the foreground signal, while the background attenuation component 540 may be configured to allow the background signal to pass without being attenuated. The background angle control component 538 may be configured to provide the appropriate perceptual angle within the background region 108.

FIG. 5 also shows control signals 532 being sent to the audio source processor 516 by a control unit 522. These control signals 532 are examples of control signals 232 that may be sent by the control unit 210 that is shown in the apparatus 200 of FIG. 2.

As indicated above, the control unit 522 may generate the control signals 532 in response to receiving a request 224 to change the perceptual location of an audio source 202. As part of generating the control signals 532, the control unit 522 may be configured to determine new values for parameters associated with the processing engine 210, and more specifically, with the audio source processor 516. The control signals 532 may include commands for setting the parameters to the new values.

The control signals 532 are shown with foreground angle control commands 542, foreground attenuation commands 544, background angle control commands 546, and background attenuation commands 548. The foreground angle control commands 542 may be commands for setting parameters associated with the foreground angle control component 534. The foreground attenuation commands 544 may be commands for setting parameters associated with the foreground attenuation component 536. The background angle control commands 546 may be commands for setting parameters associated with the background angle control component 538. The background attenuation commands 548 may be commands for setting parameters associated with the background attenuation component 540.

Figure 6:
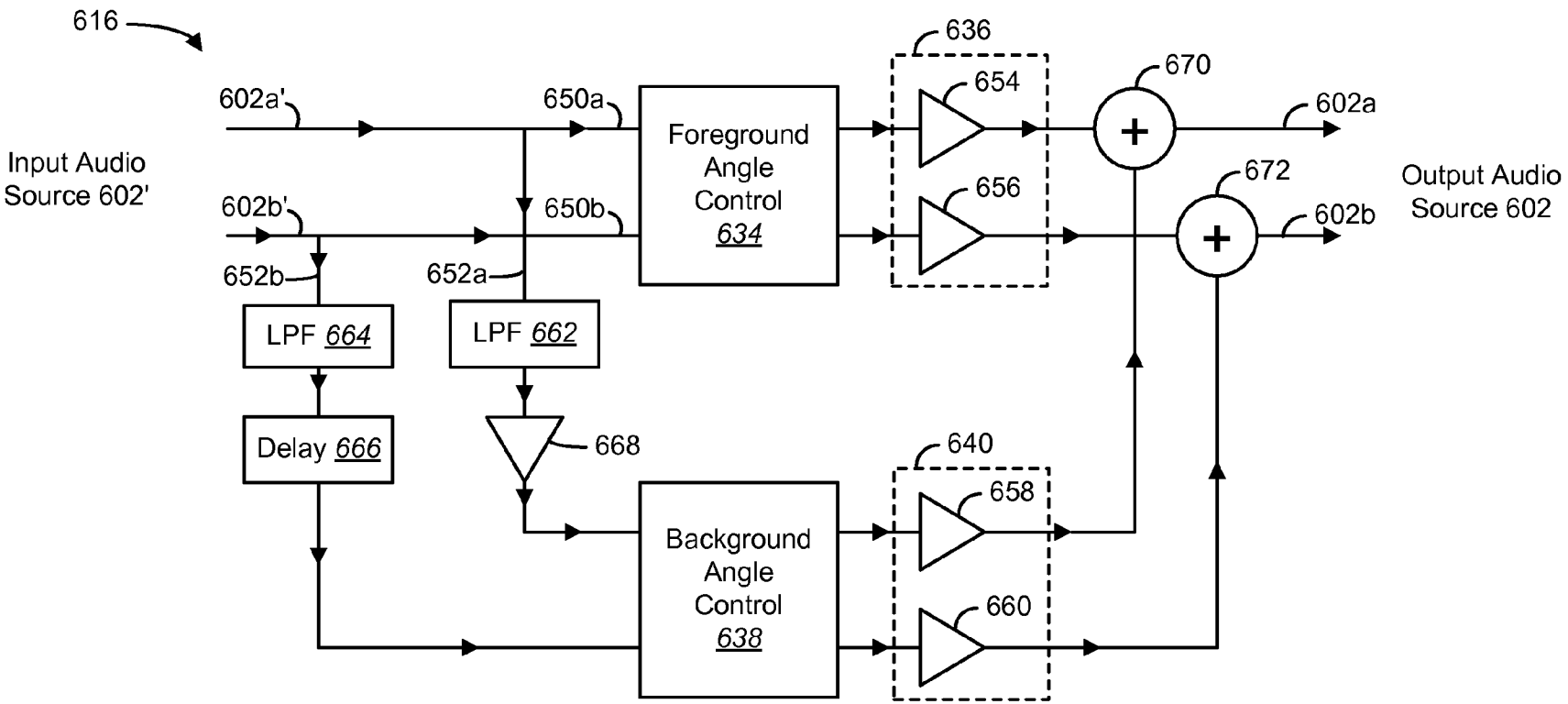
FIG. 6 illustrates one possible implementation of the audio source processor that is shown in FIG. 5.

FIG. 6 illustrates an audio source processor 616. The audio source processor 616 is one possible implementation of the audio source processor 516 that is shown in FIG. 5.

The audio source processor 616 is shown receiving an input audio source 602'. The input audio source 602' is a stereo audio source with two channels, a left channel 602*a*' and a right channel 602*b*'. The input audio source 602' is shown being split into two signals, a foreground signal 650 and a background signal 652. The foreground signal 650 is shown with two channels, a left channel 650*a* and a right channel 650*b*. Similarly, the background signal 652 is shown with two channels, a left channel 652*a* and a right channel 652*b*. The foreground signal is shown being processed along a foreground path, while the background signal 652 is shown being processed along a background path.

The left channel 652*a* and the right channel 652*b* of the background signal 652 are shown being processed by two low pass filters (LPFs) 662, 664. The right channel 652*b* of the background signal 652 is then shown being processed by a delay line 666. The length of the delay line 666 may be relatively short (e.g., 10 milliseconds). Due to a precedence effect, the interaural time difference (ITD) brought by the delay line 666 could result in a sound image skew (i.e., the sound is not perceived as centered) when both channels 652*a*, 652*b* are set to the same level. To counteract this, the left channel 652*a* of the background signal 652 is then shown being processed by an interaural intensity difference (IID) attenuation component 668. The gain of the IID attenuation component 668 may be tuned according to sampling rate and the length of the delay line 666. The processing that is done by the LPFs 662, 664, the delay line 666, and the IID attenuation component 668 may make the background signal 652 sound more diffuse than the foreground signal 650.

The audio source processor 616 is shown with a foreground angle control component 634. As indicated above, the foreground angle control component 634 may be configured to provide a foreground perceptual angle for the foreground signal 650. In addition, because the input audio source 602' is a stereo audio source, the foreground angle control component 634 may also be configured to balance the contents of the left channel 650*a* and the right channel 650*b* of the foreground signal 650. This may be done for the purpose of preserving contents of the left channel 650*a* and the right channel 650*b* of the foreground signal 650 for any perceptual angle that the foreground signal 650 may be set to.

The audio source processor 616 is also shown with a background angle control component 638. As indicated above, the background angle control component 638 may be configured to provide a background perceptual angle for the background signal 652. In addition, because the input audio source 602' is a stereo audio source, the background angle control component 638 may also be configured to balance the contents of the left channel 652*a* and the right channel 652*b* of the background signal 652. This may be done for the purpose of preserving contents of the left channel 652*a* and the right channel 652*b* of the background signal 652 for any perceptual angle that the background signal 652 may be set to.

The audio source processor 616 is also shown with a foreground attenuation component 636. As indicated above, the foreground attenuation component 636 may be configured to process the foreground signal 650 in order to provide a desired level of attenuation for the foreground signal 650. The foreground attenuation component 636 is shown with two scalars 654, 656. Collectively, these scalars 654, 656 may be referred to as foreground attenuation scalars 654, 656.

The audio source processor 616 is also shown with a background attenuation component 640. As indicated above, the background attenuation component 640 may be configured to process the background signal 652 in order to provide a desired level of attenuation for the background signal 652. The background attenuation component 640 is shown with two scalars 658, 660. Collectively, these scalars 658, 660 may be referred to as background attenuation scalars 658, 660.

The values of the foreground attenuation scalars 654, 656 may be set to achieve the desired level of attenuation for the foreground signal 650. Similarly, the values of the background attenuation scalars 658, 660 may be set to achieve the desired level of attenuation for the background signal 652. For example, to completely attenuate the foreground signal 650, the foreground attenuation scalars 654, 656 may be set to a minimum value (e.g., zero). In contrast, to allow the foreground signal 650 to pass without being attenuated, these scalars 654, 656 may be set to a maximum value (e.g., unity).

An adder 670 is shown combining the left channel 650*a* of the foreground signal 650 with the left channel 652*a* of the background signal 652. The adder 670 is shown outputting the left channel 602*a* of the output audio source 602. Another adder 672 is shown combining the right channel 650*b* of the foreground signal 650 with the right channel 652*b* of the background signal 652. This adder 672 is shown outputting the right channel 602*b* of the output audio source 602.

The audio source processor 616 illustrates how separate foreground processing and background processing may be implemented in order to change the perceptual location of an audio source 602. An input audio source 602' is shown being split into two signals, a foreground signal 650 and a background signal 652. The foreground signal 650 and the background signal 652 are then processed separately. In other words, there are differences between the way that the foreground signal 650 is processed as compared to the way that the background signal 652 is processed. The specific differences shown in FIG. 6 are that the foreground signal 650 is processed with a foreground angle control component 634 and a foreground attenuation component 636, whereas the background signal 652 is processed with a background angle control component 638 and a background attenuation component 640. In addition, the background signal 652 is processed with components (i.e., low pass filters 662, 664, a delay line 666, and an IID attenuation component 668) that make the background signal 652 sound more diffuse than the foreground signal 650, whereas the foreground signal 650 is not processed with these components.

The audio source processor 616 of FIG. 6 is just an example of one way that separate foreground processing and background processing may be implemented in order to change the perceptual location of an audio source 602. Separate foreground processing and background processing may be achieved using different components than those shown in FIG. 6. The phrase "separate foreground and background processing" should not be construed as being limited to the specific components and configuration shown in FIG. 6. Instead, separate foreground and background processing means that an input audio source 602' is split into a foreground signal 650 and a background signal 652, and there is at least one difference between the way that the foreground signal 650 is processed as compared to the way that the background signal 652 is processed.

Figure 7:
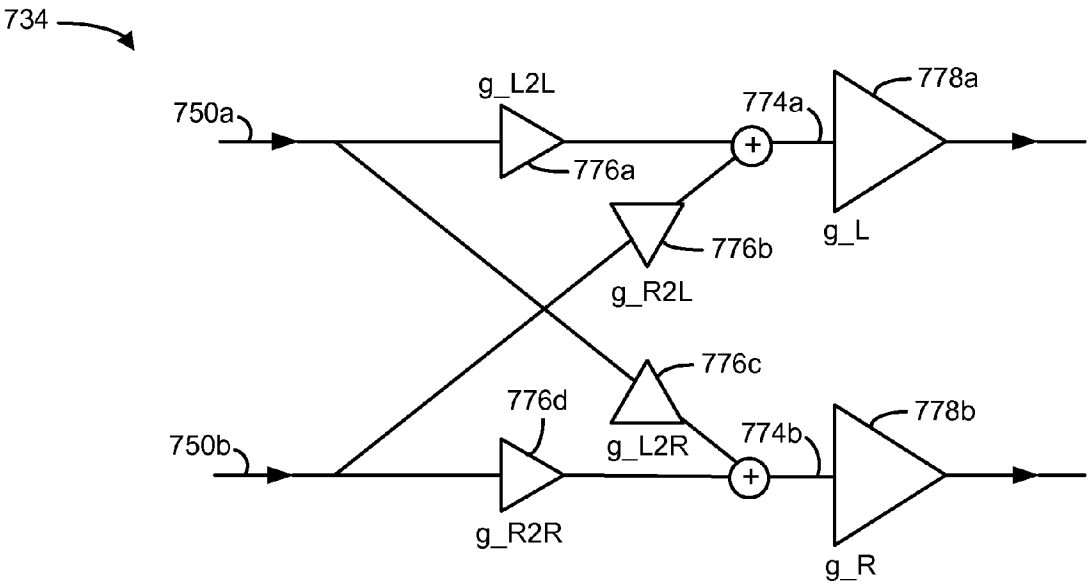
FIG. 7 illustrates one possible implementation of the foreground angle control component in the audio source processor of FIG. 6.

FIG. 7 illustrates a foreground angle control component 734. The foreground angle control component 734 is one possible implementation of the foreground angle control component 634 in the audio source processor 616 of FIG. 6. The foreground angle control component 734 is shown with two inputs: the left channel 750*a* of a foreground signal 750, and the right channel 750*b* of a foreground signal 750.

As indicated above, the foreground angle control component 734 may be configured to balance contents of the left channel 750*a* and the right channel 750*b* of the foreground signal 750. This may be accomplished by redistributing the contents of the left channel 750*a* and the right channel 750*b* of the foreground signal 750 to two signals 774*a*, 774*b*. These signals 774*a*, 774*b* may be referred to as content-balanced signals 774*a*, 774*b*. The content-balanced signals 774*a*, 774*b* may both include a substantially equal mixture of the contents of the left channel 750*a* and the right channel 750*b* of the foreground signal 750. To distinguish the content-balanced signals 774 from each other, one content-balanced signal 774*a* may be referred to as a left content-balanced signal 774*a*, while the other content-balanced signal 774*b* may be referred to as a right content-balanced signal 774*b*.

Mixing scalars 776 may be used to redistribute the contents of the left channel 750*a* and the right channel 750*b* of the foreground signal 750 to the two content-balanced signals 774*a*, 774*b*. In FIG. 7 these mixing scalars 776 are labeled as the g_L2L scalar 776*a*, the g_R2L scalar 776*b*, the g_L2R scalar 776*c*, and the g_R2R scalar 776*d*. The left content-balanced signal 774*a* may include the left channel 750*a* multiplied by the g_L2L scalar 776*a*, and the right channel 750*b* multiplied by the g_R2L scalar 776*b*. The right content-balanced signal 774*b* may include the right channel 750*b* multiplied by the g_R2R scalar 776*d*, and the left channel 750*a* multiplied by the g_L2R scalar 776*c*.

As indicated above, the foreground angle control component 734 may also be configured to provide a perceptual angle within the foreground region 106 for the foreground signal 750. This may be accomplished through the use of two scalars 778, which may be referred to as foreground angle control scalars 778. In FIG. 7 these foreground angle control scalars 778 are labeled as the g_L scalar 778*a* and the g_R scalar 778*b*. The left content-balanced signal 774*a* may be multiplied by the g_L scalar 778*a*, and the right content-balanced signal 774*b* may be multiplied by the g_R scalar 778*b*.

To achieve a perceptual angle between 270° and 0° (i.e., on the left side of the foreground region 106), the values of the foreground angle control scalars 778 may be set so that the right content-balanced signal 774*b* is more greatly attenuated than the left content-balanced signal 774*a*. Conversely, to achieve a perceptual angle location between 0° and 90° (i.e., on the right side of the foreground region 106), the values of the foreground angle control scalars 778 may be set so that the left content-balanced signal 774*a* is more greatly attenuated than the right content-balanced signal 774*b*. To achieve a perceptual location that is directly in front of the listener 104 (0°), the values of the foreground angle control scalars 778 may be set so that the left content-balanced signal 774*a* and the right content-balanced signal 774*b* are equally attenuated.

Figure 8:
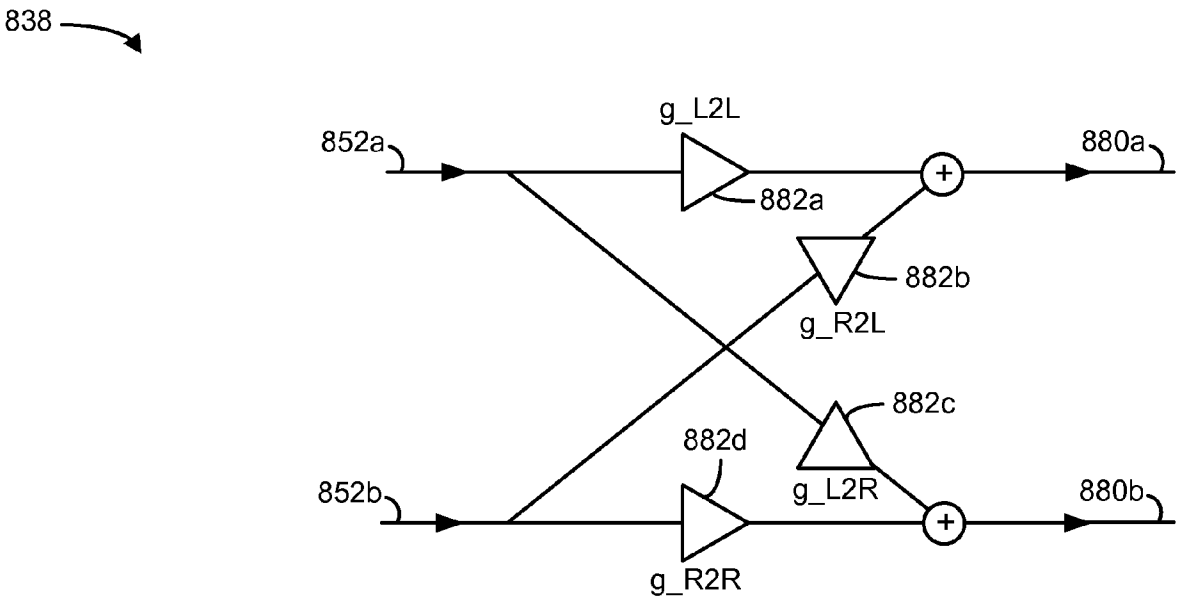
FIG. 8 illustrates one possible implementation of the background angle control component in the audio source processor of FIG. 6.

FIG. 8 illustrates a background angle control component 838. The background angle control component 838 is one possible implementation of the background angle control component 638 in the audio source processor 616 of FIG. 6. The background angle control component 838 is shown with two inputs: the left channel 852*a* of a background signal 852, and the right channel 852*b* of a background signal 852.

As indicated above, the background angle control component 838 may be configured to balance contents of the left channel 852*a* and the right channel 852*b* of the background signal 852. This may be accomplished by redistributing the contents of the left channel 852*a* and the right channel 852*b* of the background signal 852 to two content-balanced signals 880, which may be referred to as a left content-balanced signal 880*a* and a right content-balanced signal 880*b*. The content-balanced signals 880*a*, 880*b* may both include a substantially equal mixture of the contents of the left channel 852*a* and the right channel 852*b* of the background signal 852.

Mixing scalars 882 may be used to redistribute the contents of the left channel 852*a* and the right channel 852*b* of the background signal 852 to the two content-balanced signals 880*a*, 880*b*. In FIG. 8 these mixing scalars 880 are labeled as the g_L2L scalar 882*a*, the g_R2L scalar 882*b*, the g_L2R scalar 882*c*, and the g_R2R scalar 882*d*. The left content-balanced signal 880*a* may include the left channel 852*a* multiplied by the g_L2L scalar 882*a*, and the right channel 852*b* multiplied by the g_R2L scalar 882*b*. The right content-balanced signal 880*b* may include the right channel 852*b* multiplied by the g_R2R scalar 882*d*, and the left channel 852*a* multiplied by the g_L2R scalar 882*c*.

As indicated above, the background angle control component 838 may also be configured to provide a perceptual angle within the background region 108 for the background signal 852. This may be accomplished by tuning the values of the four mixing scalars 882 so that these scalars 882 also perform the function of providing a perceptual angle for the background signal 882 in addition to the function of redistributing contents of the left and right channels 852*a*, 852*b* of the background signal 852. Thus, the background angle control component 838 is shown without any dedicated angle control scalars (such as the g_L scalar 778*a* and the g_R scalar 778*b* in the foreground angle control component 734 shown in FIG. 7). The mixing scalars 882 may be referred to as mixing/angle control scalars 882, because they may perform both of these functions. The mixing/angle control scalars 882 may be able to perform both mixing and angle control functions because for processing in the background region 108, the sound is diffused already, so it is not necessary to provide as accurate of a sound image as in the foreground region 106.

Figure 9B:
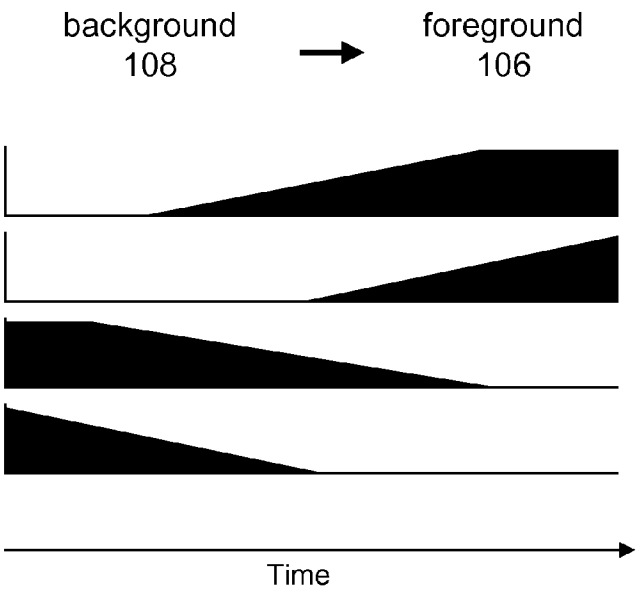
Figure 9A:
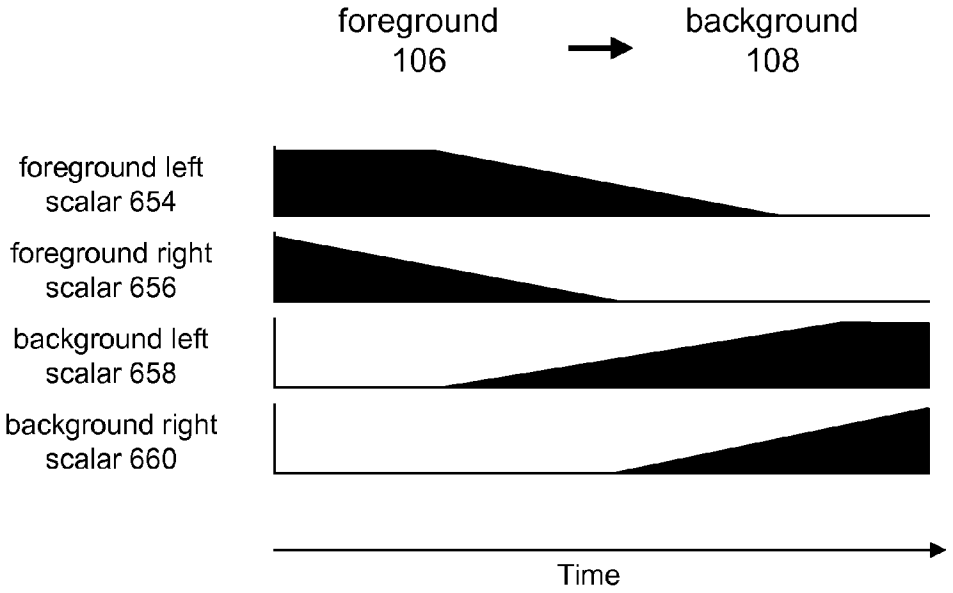

FIG. 9A illustrates how the values of the foreground attenuation scalars 654, 656 and the background attenuation scalars 658, 660 in the audio source processor 616 shown in FIG. 6 may change over time as the perceptual location of an audio source 202 is changed from a current location in the foreground region 106 to a new location in the background region 108. FIG. 9B illustrates how the values of the foreground attenuation scalars 654, 656 and the background attenuation scalars 658, 660 may change over time as the perceptual location of an audio source 202 is changed from a current location in the background region 108 to a new location in the foreground region 106.

As indicated above, the control signals 532 that the control unit 522 sends to the audio source processor 516 may include foreground attenuation commands 544 and background attenuation commands 548. The foreground attenuation commands 544 may include commands for setting the values of the foreground attenuation scalars 654, 656 in accordance with the values shown in FIGS. 9A and 9B. The foreground attenuation commands 544 may cause the values of the foreground attenuation scalars 654, 656 to gradually decrease (FIG. 9A) or to gradually increase (FIG. 9B), as appropriate. The background attenuation commands 548 may include commands for setting the values of the background attenuation scalars 658, 660 in accordance with the values shown in FIGS. 9A and 9B. The background attenuation commands 548 may cause the values of the background attenuation scalars 658, 660 to gradually increase (FIG. 9A) or to gradually decrease (FIG. 9B), as appropriate.

The values of the foreground attenuation scalars 654, 656 and the background attenuation scalars 658, 660 shown in FIGS. 9A and 9B are examples only. Other values for these scalars 654, 656, 658, 660 may be used. For example, the values for the foreground left scalar 654 and the foreground right scalar 656 could be switched, and the values for the background left scalar 658 and the background right scalar 660 could be switched. This may cause the transition between foreground and background to appear to the "opposite side", i.e., a left-side transition with the values as shown in FIGS. 9A and 9B may become a right-side transition if the values were switched as described above. The sound as a whole may not be an exact left-right mirror, however, because the control unit 522 may be configured to automatically choose the arc that is less than 180 degrees to execute. For example, consider a transition from 120° to 270°. For this type of transition, the values shown in FIGS. 9A and 9B would make an arc-like movement on the left side of a sonic space. If the values were switched as described above, the arc would be along the right side instead, but would still start from 120° and end at 270°.

FIG. 10 is a table 1084 that illustrates examples of possible values for the foreground attenuation scalars 654, 656 and the background attenuation scalars 658, 660 in the audio source processor 616 shown in FIG. 6 when the perceptual location of an audio source 202 changes within the foreground region 106, or within the background region 108. As can be seen from this table 1084, the values of the foreground attenuation scalars 654, 656 and the background attenuation scalars 658, 660 may not change during these types of transitions.

The table 1084 includes a column 1086 that shows examples of values for the foreground attenuation scalars 654, 656 and the background attenuation scalars 658, 660 when the perceptual location of an audio source 202 is changed from a current location in the foreground region 106 to a new location that is also in the foreground region 106. Another column 1088 shows examples of values for the foreground attenuation scalars 654, 656 and the background attenuation scalars 658, 660 when the perceptual location of an audio source 202 is changed from a current location in the background region 108 to a new location that is also in the background region 108.

Figure 11:
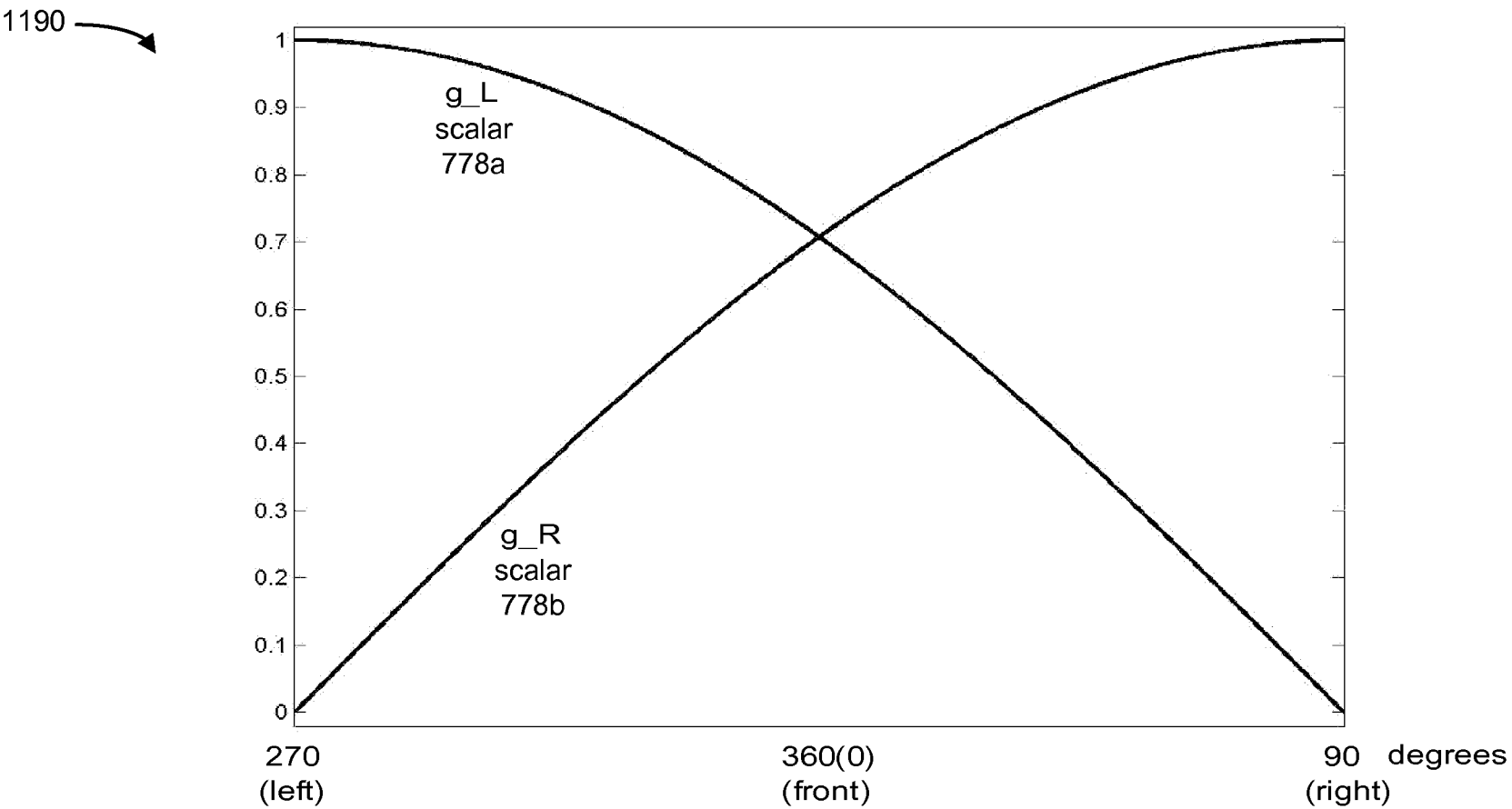
FIG. 11 illustrates examples of possible values for the foreground angle control scalars in the foreground angle control component of FIG. 7.

FIG. 11 is a graph 1190 showing examples of possible values for the foreground angle control scalars 778*a*, 778*b* in the foreground angle control component 734 shown in FIG. 7 relative to possible perceptual locations within the foreground region 106 (i.e., from 270° to 360°, and from 0° to 90°). The foreground angle control scalars 778*a*, 778*b* are labeled as the g_L scalar 778*a* and the g_R scalar 778*b*. These labels correspond to the labels that are provided for the foreground angle control scalars 778*a*, 778*b* in FIG. 7.

As indicated above, the control signals 532 that the control unit 522 sends to the audio source processor 516 may include foreground angle control commands 542. The foreground angle control commands 542 may include commands for setting the values of the foreground angle control scalars 778*a*, 778*b* in accordance with the values shown in FIG. 11. If the perceptual location is changing from the background region 108 to the foreground region 106, the foreground angle control commands 542 may be configured to immediately set the foreground angle control scalars 778*a*, 778*b* to values that correspond to the new perceptual location of the audio source 202 in the foreground region 106. If the perceptual location is changing within the foreground region 106, the foreground angle control commands 542 may be configured to gradually transition the values of the foreground angle control scalars 778*a*, 778*b* from values corresponding to the current perceptual location to values corresponding to the new perceptual location.

Figure 12:
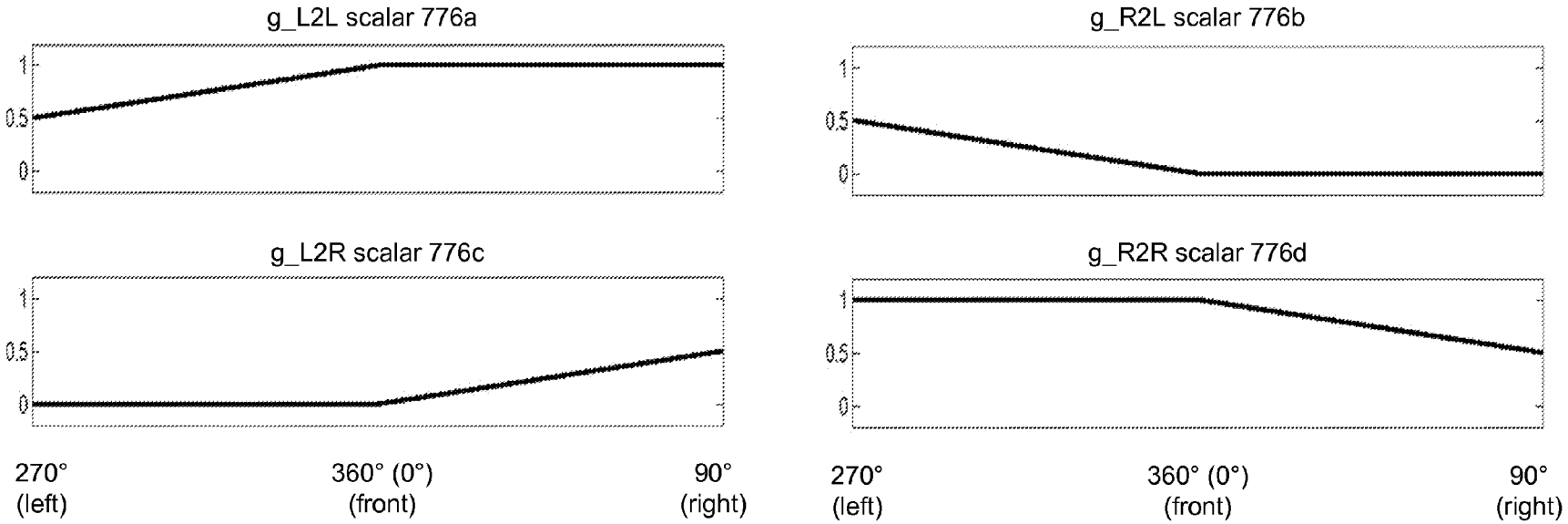
FIG. 12 illustrates examples of possible values for the foreground mixing scalars in the foreground angle control component of FIG. 7.

FIG. 12 illustrates examples of possible values for the mixing scalars 776 in the foreground angle control component 734 shown in FIG. 7 relative to possible perceptual locations within the foreground region 106 (i.e., from 270° to 360°, and from 0° to 90°). The mixing scalars 776 are labeled as the g_L2L scalar 776*a*, the g_R2L scalar 776*b*, the g_L2R scalar 776*c*, and the g_R2R scalar 776*d*. These labels correspond to the labels that are provided for the mixing scalars 776 in FIG. 7.

As indicated above, the control signals 532 that the control unit 522 sends to the audio source processor 516 may include foreground angle control commands 542. The foreground angle control commands 542 may include commands for setting the values of the mixing scalars 776 in accordance with the values shown in FIG. 12. If the perceptual location is changing from the background region 108 to the foreground region 106, the foreground angle control commands 542 may be configured to immediately set the mixing scalars 776 to values that correspond to the new perceptual location of the audio source 202 in the foreground region 106. If the perceptual location is changing within the foreground region 106, the foreground angle control commands 542 may be configured to gradually transition the values of the mixing scalars 776 from values corresponding to the current perceptual location to values corresponding to the new perceptual location.

Figure 13:
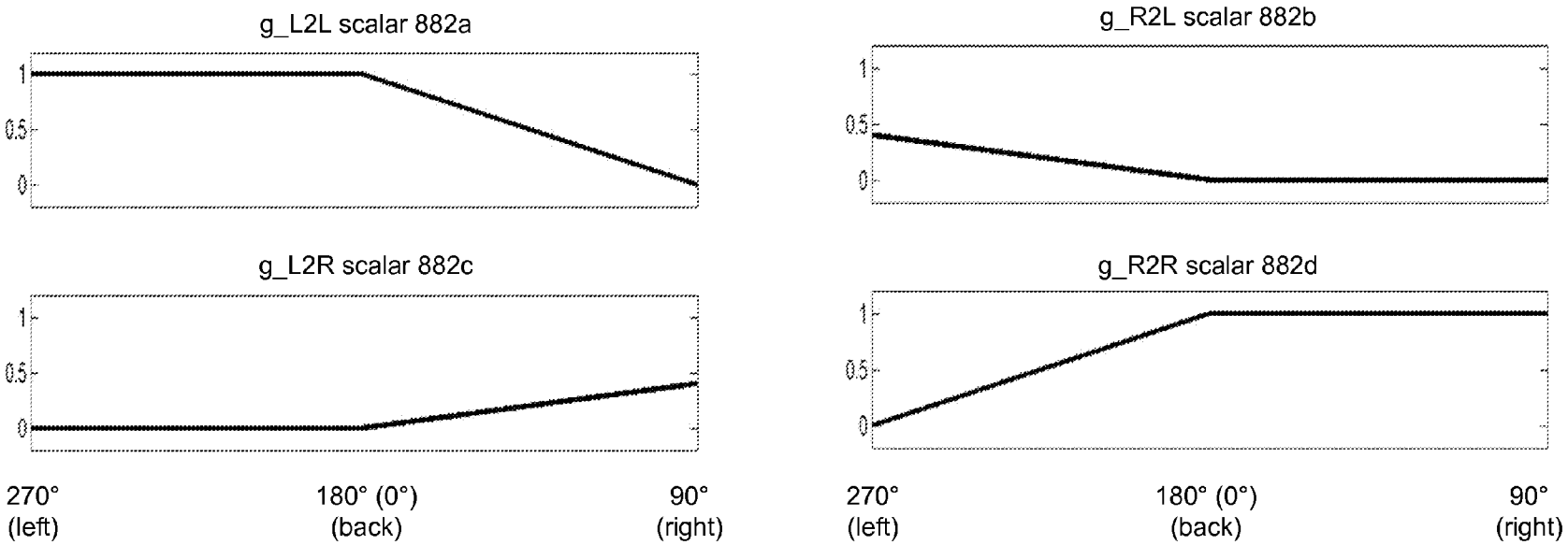
FIG. 13 illustrates examples of possible values for the background mixing scalars in the background angle control component of FIG. 8.

FIG. 13 illustrates examples of possible values for the mixing/angle control scalars 882 in the background angle control component 838 shown in FIG. 8 relative to possible perceptual locations within the background region 108 (i.e., from 270° to 90°). The mixing/angle control scalars 882 are labeled as the g_L2L scalar 882*a*, the g_R2L scalar 882*b*, the g_L2R scalar 882*c*, and the g_R2R scalar 882*d*. These labels correspond to the labels that are provided for the mixing/angle control scalars 882 in FIG. 8.

As indicated above, the control signals 532 that the control unit 522 sends to the audio source processor 516 may include background angle control commands 546. The background angle control commands 546 may include commands for setting the values of the mixing/angle control scalars 882 in accordance with the values shown in FIG. 13. If the perceptual location is changing from the foreground region 106 to the background region 108, the background angle control commands 546 may be configured to immediately set the mixing/angle control scalars 882 to values that correspond to the new perceptual location of the audio source 202 in the background region 108. If the perceptual location is changing within the background region 108, the background angle control commands 546 may be configured to gradually transition the values of the mixing/angle control scalars 882 from values corresponding to the current perceptual location to values corresponding to the new perceptual location.

Figure 14:
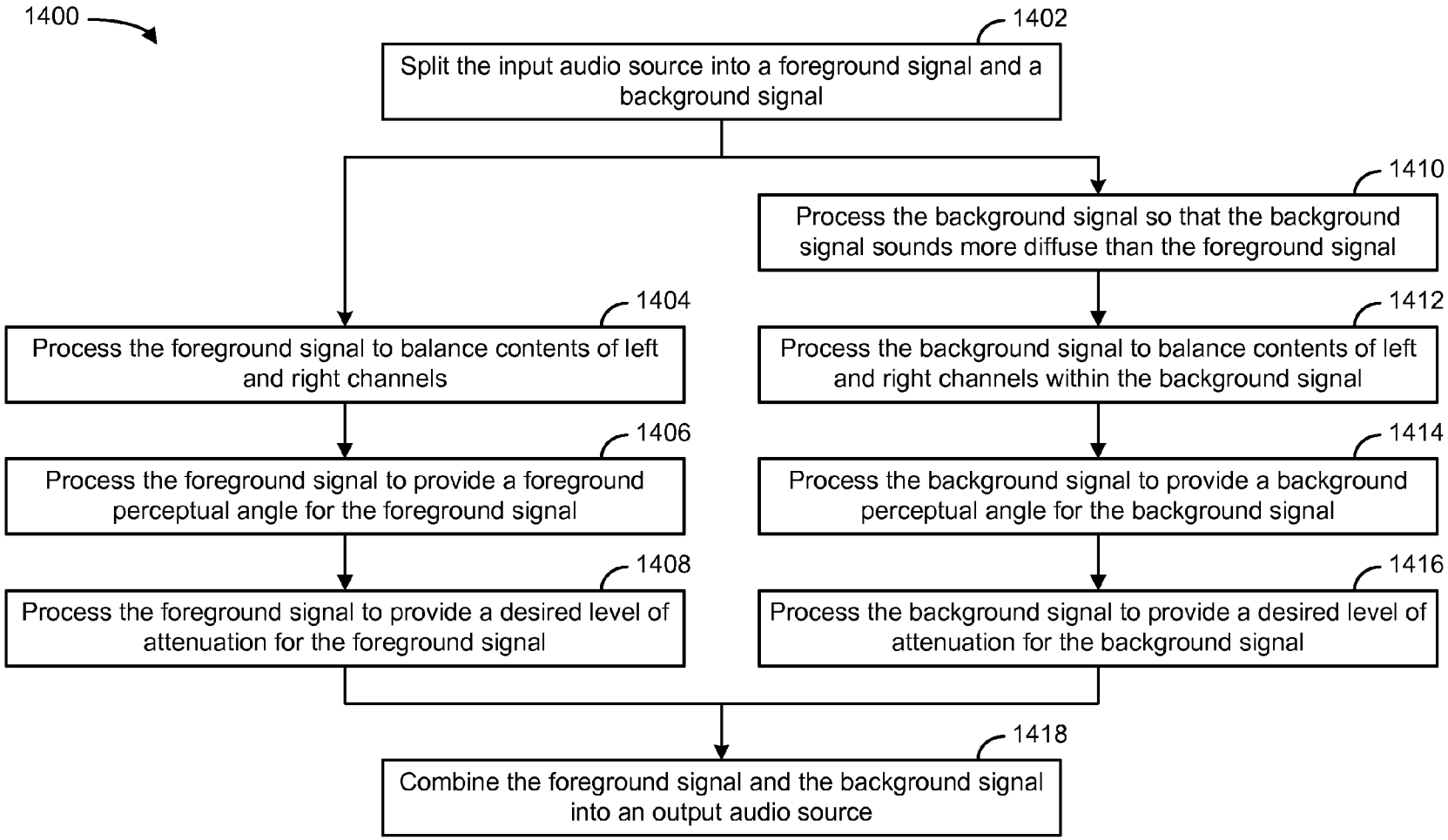
FIG. 14 illustrates a method for providing a distinct perceptual location for an audio source within an audio mixture.

FIG. 14 illustrates a method 1400 for providing a distinct perceptual location for an audio source 602 within an audio mixture 212. The method 1400 may be performed by the audio source processor 616 that is shown in FIG. 6.

In accordance with the method 1400, an input audio source 602' may be split 1402 into a foreground signal 650 and a background signal 652. The foreground signal 650 may be processed differently than the background signal 652.

The processing of the foreground signal 650 will be discussed first. If the input audio source 602' is a stereo audio source, the foreground signal 650 may be processed 1404 to balance contents of the left channel 650*a* and the right channel 650*b* of the foreground signal 650. The foreground signal 650 may also be processed 1406 to provide a foreground perceptual angle for the foreground signal 650. The foreground signal 650 may also be processed 1408 to provide a desired level of attenuation for the foreground signal 650.

The processing of the background signal 652 will now be discussed. The background signal 652 may be processed 1410 so that the background signal 652 sounds more diffuse than the foreground signal 650. If the input audio source 602' is a stereo audio source, the background signal 652 may be processed 1412 to balance contents of the left channel 652*a* and the right channel 652*b* of the background signal 652. The background signal 652 may also be processed 1414 to provide a background perceptual angle for the background signal 652. The background signal 652 may also be processed 1416 to provide a desired level of attenuation for the background signal 652.

The foreground signal 650 and the background signal 652 may then be combined 1418 into an output audio source 602. The output audio source 602 may then be combined with other output audio sources to create an audio mixture 212.

The method 1400 of FIG. 14 illustrates how separate foreground processing and background processing of an input audio source 602' may be implemented. The steps of balancing 1404 contents of the left channel 650*a* and the right channel 650*b* of the foreground signal 650, providing 1406 a foreground perceptual angle for the foreground signal 650, and providing 1408 a desired level of attenuation for the foreground signal 650 correspond to foreground processing of the input audio source 602'. The steps of processing 1410 the background signal 652 to sound more diffuse than the foreground signal 650, balancing 1412 contents of the left channel 652*a* and the right channel 652*b* of the background signal 652, providing 1414 a background perceptual angle for the background signal 652, and providing 1416 a desired level of attenuation for the background signal 652 correspond to background processing of the input audio source 602'. Because there is at least one difference between the way that the foreground signal 650 is processed as compared to the way that the background signal 652 is processed, it may be said that the foreground signal 650 is processed separately than the background signal 652.

Although the method 1400 of FIG. 14 illustrates one way that separate foreground processing and background processing may be implemented in order to change the perceptual location of an audio source 602, the phrase "separate foreground and background processing" should not be construed as being limited to the specific steps shown in FIG. 14. Instead, as indicated above, separate foreground and background processing means that an input audio source 602' is split into a foreground signal 650 and a background signal 652, and there is at least one difference between the way that the foreground signal 650 is processed as compared to the way that the background signal 652 is processed.

Figure 15:
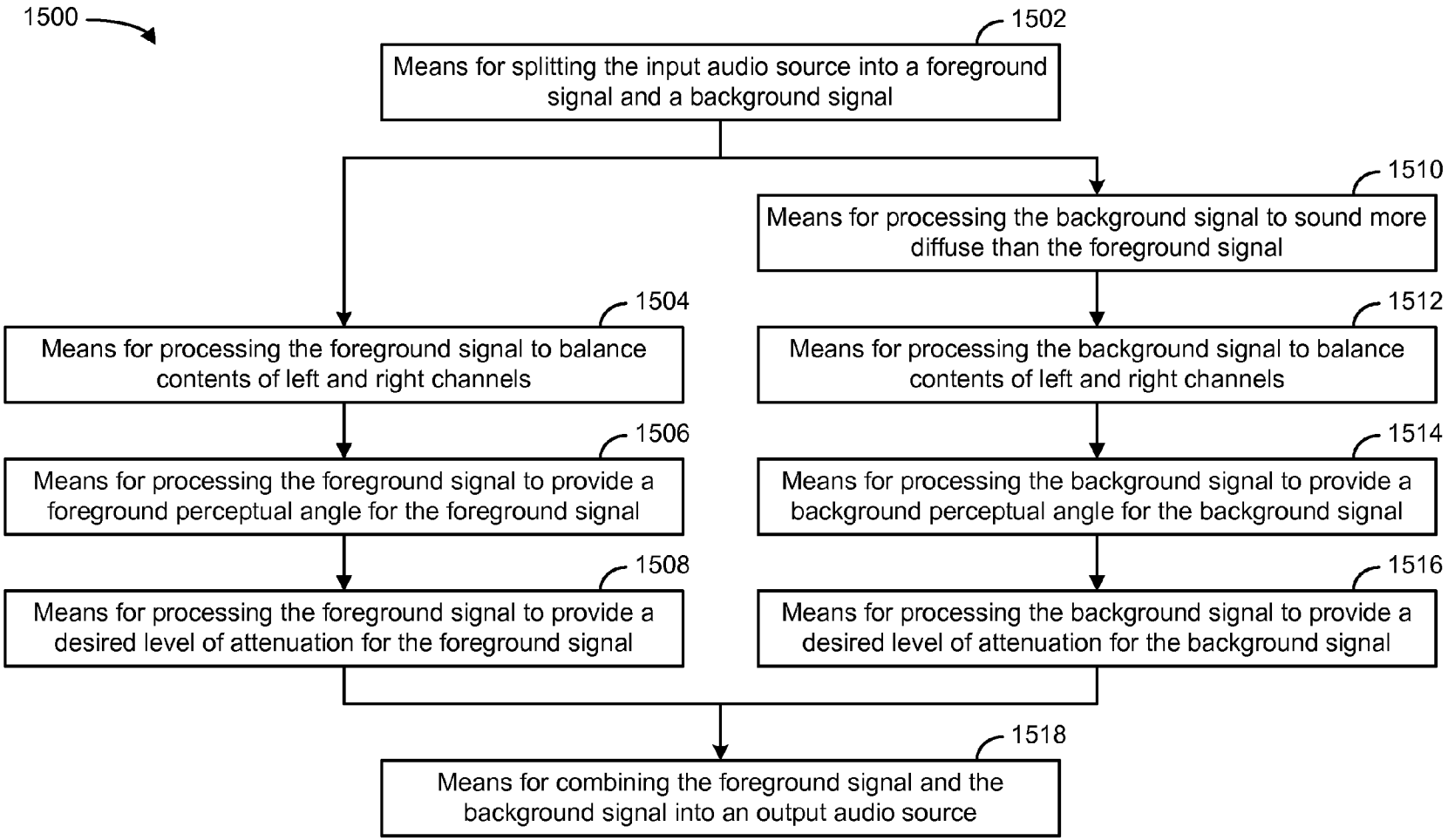
FIG. 15 illustrates means-plus-function blocks corresponding to the method shown in FIG. 14.

The method 1400 of FIG. 14 described above may be performed by corresponding means-plus-function blocks illustrated in FIG. 15. In other words, blocks 1402 through 1418 illustrated in FIG. 14 correspond to means-plus-function blocks 1502 through 1518 illustrated in FIG. 15.

Figure 16:
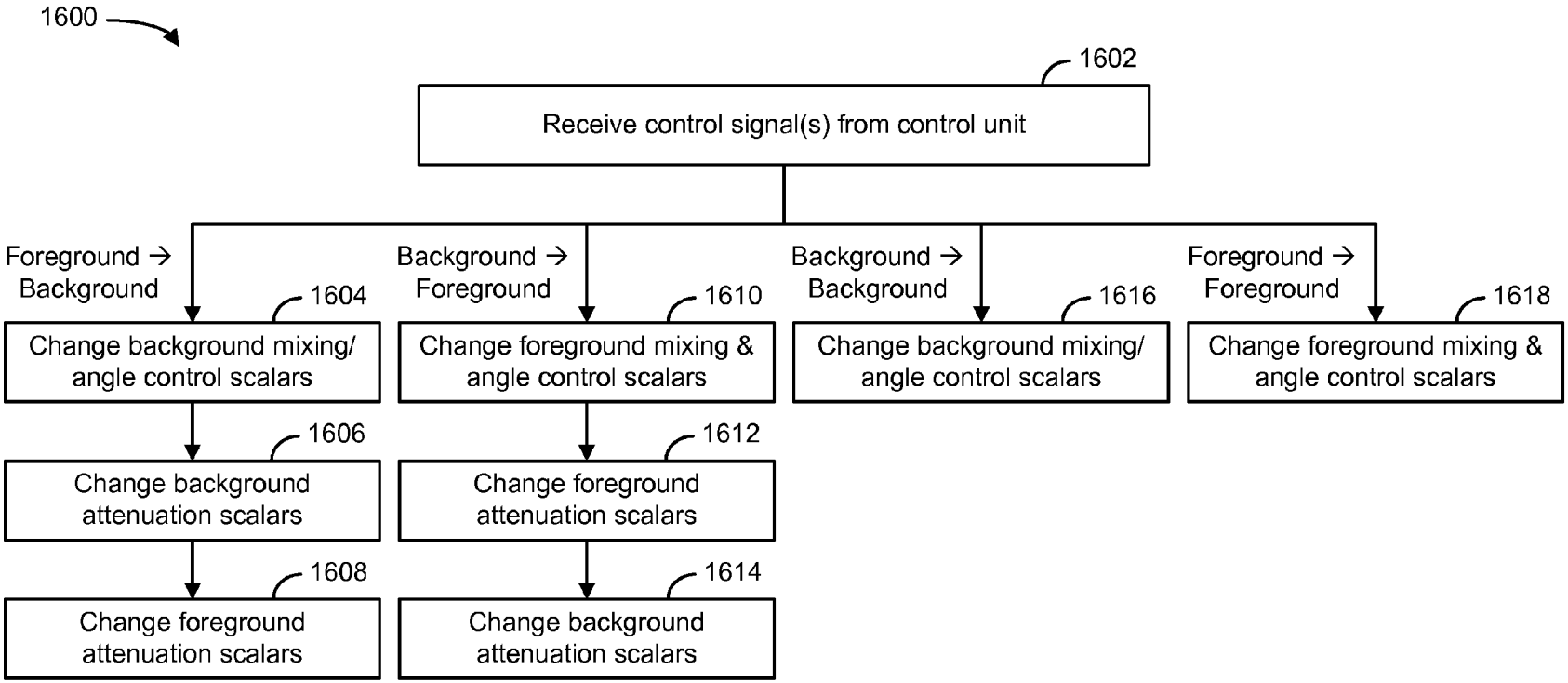
FIG. 16 illustrates a method for changing the perceptual location of an audio source.

FIG. 16 illustrates a method 1600 for changing the perceptual location of an audio source 602. The method 1600 may be performed by the audio source processor 616 that is shown in FIG. 6.

In accordance with the method 1600, control signals 532 may be received 1602 from a control unit 522. These control signals 532 may include commands for setting various parameters of the audio source processor 616.

For example, suppose that the perceptual location of an audio source 602 is being changed from the foreground region 106 to the background region 108. The control signals 532 may include commands 546 to immediately set the mixing/angle control scalars 882 within the background angle control component 838 to values that correspond to the new perceptual location of the audio source 602. The values of the mixing/angle control scalars 882 may be changed 1604 in accordance with these commands 546.

The control signals 532 may also include commands 548 to gradually transition the values of the background attenuation scalars 658, 660 from values that result in complete attenuation of the background signal 652 to values that result in no attenuation of the background signal 652. The values of the background attenuation scalars 658, 660 may be changed 1606 in accordance with these commands 548.

The control signals 532 may also include commands 544 to gradually transition the values of the foreground attenuation scalars 654, 656 from values that result in no attenuation of the foreground signal 650 to values that result in complete attenuation of the foreground signal 650. The values of the foreground attenuation scalars 654, 656 may be changed 1608 in accordance with these commands 544.

Conversely, suppose that the perceptual location of an audio source 602 is being changed from the background region 108 to the foreground region 106. The control signals 532 may include commands 542 to immediately set the foreground mixing scalars 776 and the foreground angle control scalars 778 within the foreground angle control component 734 to values that correspond to the new perceptual location of the audio source 602. The values of the foreground mixing scalars 776 and the foreground angle control scalars 778 may be changed 1610 in accordance with these commands 542.

The control signals 532 may also include commands 544 to gradually transition the values of the foreground attenuation scalars 654, 656 from values that result in complete attenuation of the foreground signal 650 to values that result in no attenuation of the foreground signal 650. The values of the foreground attenuation scalars 654, 656 may be changed 1612 in accordance with these commands 544.

The control signals 532 may also include commands 548 to gradually transition the values of the background attenuation scalars 658, 660 from values that result in no attenuation of the background signal 652 to values that result in complete attenuation of the background signal 652. The values of the background attenuation scalars 658, 660 may be changed 1614 in accordance with these commands 548.

If the perceptual location of an audio source 602 is being changed within the background region 108, the control signals 532 may also include commands 546 to gradually transition the values of the mixing/angle control scalars 882 within the background angle control component 838 from values that correspond to the current perceptual location to values that correspond to the new perceptual location. The values of the mixing/angle control scalars 882 may be changed 1616 in accordance with these commands 548.

If the perceptual location of an audio source 602 is being changed within the foreground region 106, the control signals 532 may also include commands 542 to gradually transition the values of the foreground mixing scalars 776 and the foreground angle control scalars 778 within the foreground angle control component 734 from values that correspond to the current perceptual location to values that correspond to the new perceptual location. The values of the foreground mixing scalars 776 and the foreground angle control scalars 778 may be changed 1618 in accordance with these commands 542.

The method 1600 of FIG. 16 may be implemented such that for any transition, the arc that is less than 180° to execute may be automatically selected. For example, consider a transition from 120° to 270°. With reference to the definition of a perceptual angle that is shown in FIG. 1 (where 0° is straight in front of the listener 104), this transition could be made in a counter-clockwise direction or a clockwise direction. However, in this example the clockwise direction would be less than 180° and the counter-clockwise direction would be greater than 180°. As a result, the arc that corresponds to the clockwise direction may be automatically selected.

Figure 17:
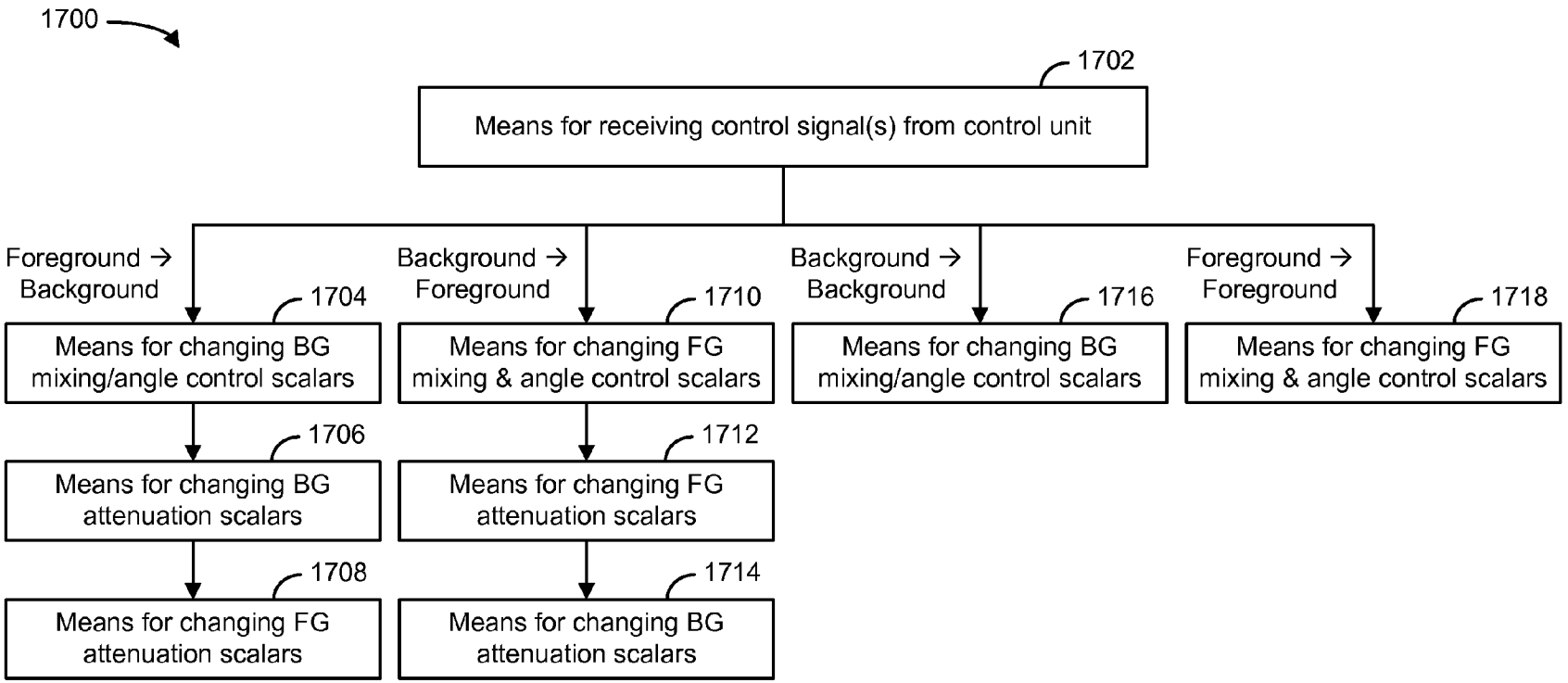
FIG. 17 illustrates means-plus-function blocks corresponding to the method shown in FIG. 16.

The method 1600 of FIG. 16 described above may be performed by corresponding means-plus-function blocks 1700 illustrated in FIG. 17. In other words, blocks 1602 through 1618 illustrated in FIG. 16 correspond to means-plus-function blocks 1702 through 1718 illustrated in FIG. 17.

Figure 18:
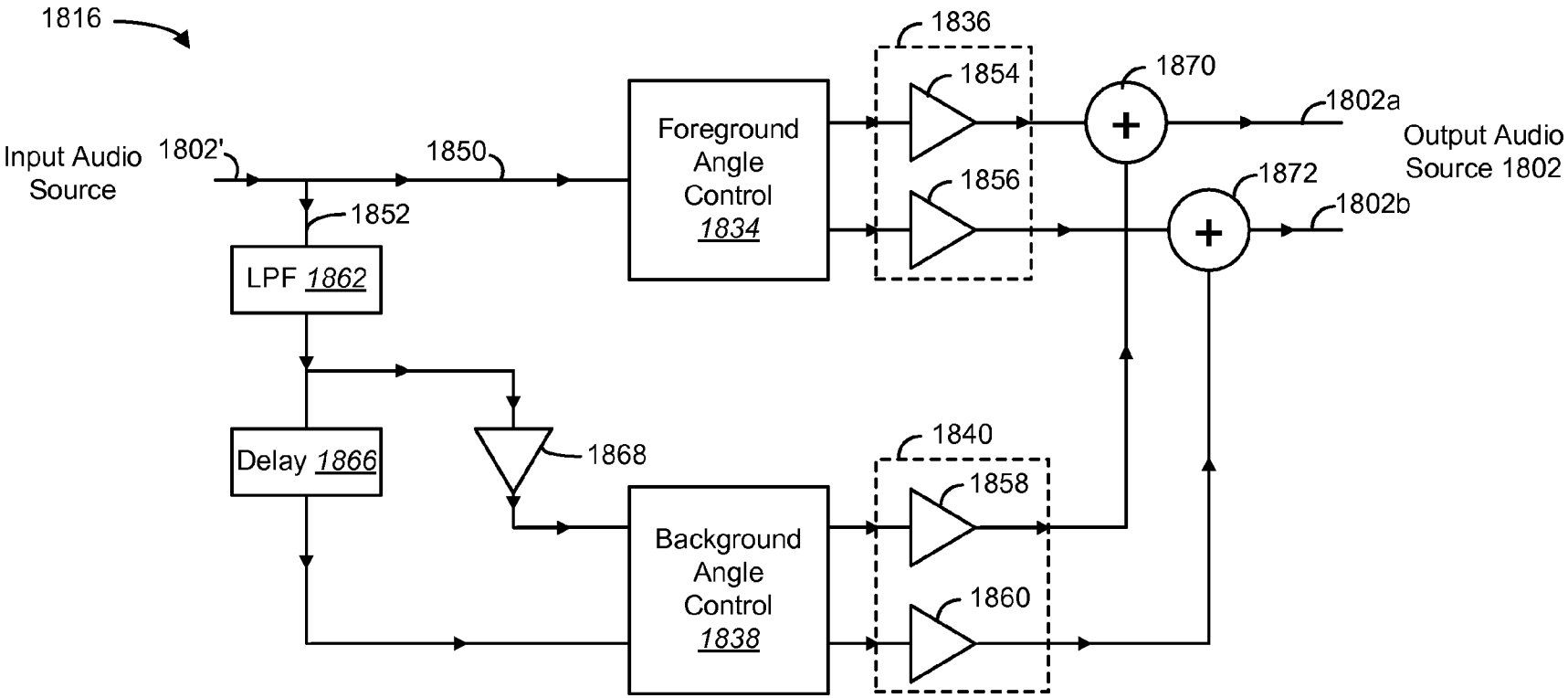
FIG. 18 illustrates an audio source processor that is configured to process single-channel (mono) audio signals.

FIG. 18 illustrates an audio source processor 1816. The audio source processor 1816 is another possible implementation of the audio source processor 516 of FIG. 5. The audio source processor 1816 is configured to process single-channel (mono) audio signals.

The audio source processor 1816 shown in FIG. 18 may be similar in some respects to the audio source processor 616 shown in FIG. 6. Components of the audio source processor 1816 shown in FIG. 18 that are similar to components of the audio source processor 616 shown in FIG. 6 are labeled with corresponding reference numbers.

There are some differences between the audio source processor 1816 shown in FIG. 18 and the audio source processor 616 shown in FIG. 6. For example, the audio source processor 1816 is shown receiving an input audio source 1802' that has just one channel. In contrast, the audio source processor 616 shown in FIG. 6 is shown receiving an input audio source 602' having two channels 602*a*', 602*b*'.

The input audio source 1802' is shown being split into a foreground signal 1850 and a background signal 1852. Because the input audio source 1802' includes one channel, the foreground signal 1850 and the background signal 1852 both initially include one channel.

Because the foreground signal 1850 initially includes just one channel, the foreground angle control component 1834 may be configured to receive just one input 1850. In contrast, as discussed above, the foreground angle control component 634 in the audio source processor 616 of FIG. 6 may be configured to receive two inputs 650*a*, 650*b*. The foreground angle control component 1834 shown in FIG. 18 may be configured to split the single channel of the foreground signal 1850 into two signals.

The foreground angle control component 1834 in the audio source processor 1816 of FIG. 18 may be configured to provide a foreground perceptual angle for the foreground signal 1850. However, because the foreground signal 1850 initially includes one channel, the foreground angle control component 1834 may not be configured to balance the contents of multiple channels, as was the case with the foreground angle control component 634 in the audio source processor 616 of FIG. 6.

As mentioned, the background signal 1852 also initially includes just one channel. Thus, the audio source processor 1816 of FIG. 18 is shown with just one low pass filter 1862, instead of the two low pass filters 662, 664 that are shown in the audio source processor 616 of FIG. 6. The output of the single low pass filter 1862 may be split into two signals, one signal that is provided to the delay line 1866, and another signal that is provided to the IID attenuation component 1868.

The audio source processor 1816 shown in FIG. 18 illustrates another example of how separate foreground processing and background processing may be implemented in order to change the perceptual location of an audio source 1802. An input audio source 1802' is shown being split into two signals, a foreground signal 1850 and a background signal 1852. The foreground signal 1850 and the background signal 1852 are then processed separately. In other words, there are differences between the way that the foreground signal 1850 is processed as compared to the way that the background signal 1852 is processed. These differences were described above.

Figure 19:
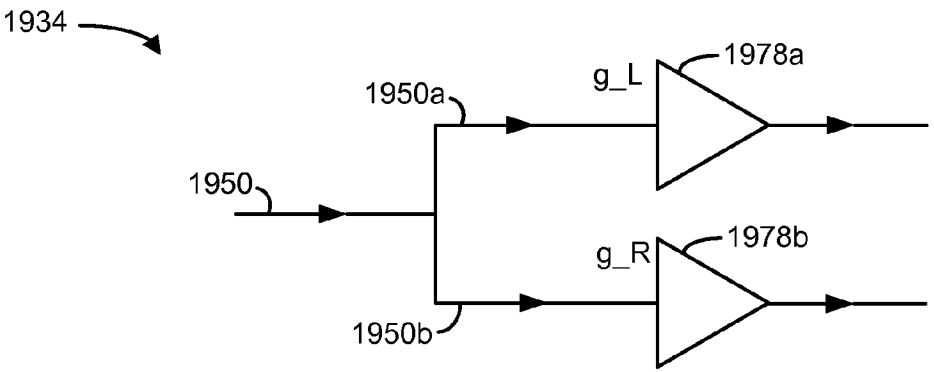
FIG. 19 illustrates one possible implementation of the foreground angle control component in the audio source processor of FIG. 18.

FIG. 19 illustrates a foreground angle control component 1934. The foreground angle control component 1934 is one possible implementation of the foreground angle control component 1834 in the audio source processor 1816 of FIG. 18.

The foreground angle control component 1934 is shown receiving the single channel of a foreground signal 1950 as input. The foreground angle control component 1934 may be configured to provide a foreground perceptual angle for the foreground signal 1950. This may be accomplished through the use of two foreground angle control scalars 1978*a*, 1978*b*, which in FIG. 19 are labeled as the g_L scalar 1978*a* and the g_R scalar 1978*b*. The foreground signal 1950 may be split into two signals 1950*a*, 1950*b*. One signal 1950*a* may be multiplied by the g_L scalar 1978*a*, and the other signal 1950*b* may be multiplied by the g_R scalar 1978*b*.

Figure 20:
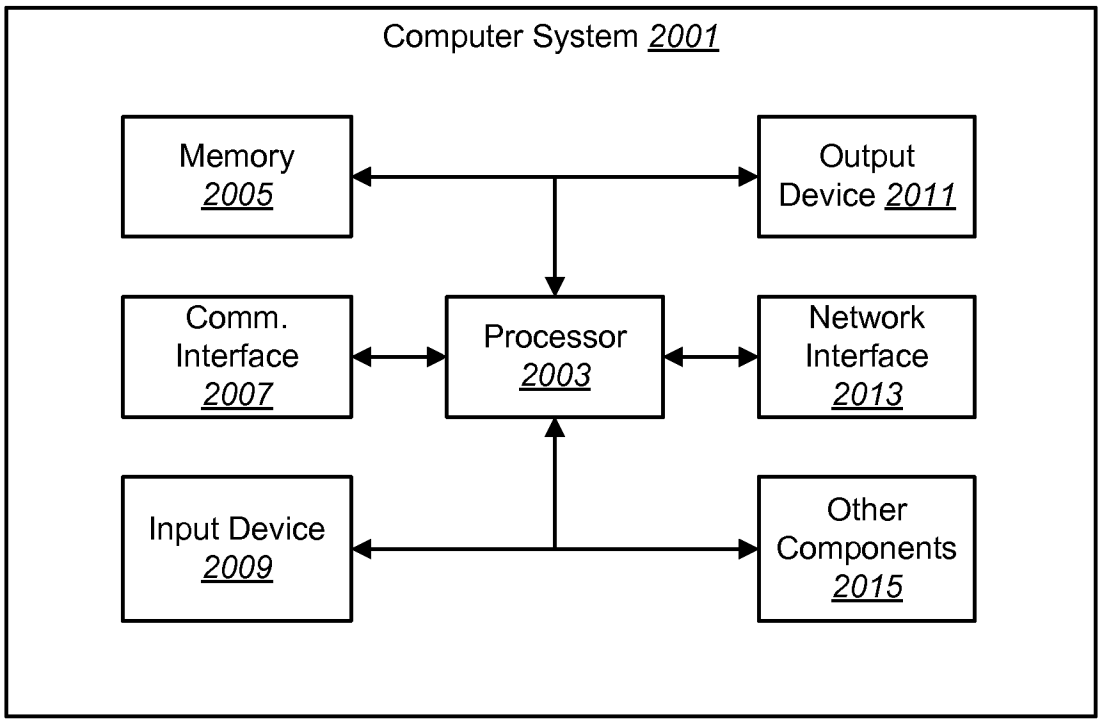
FIG. 20 illustrates various components that may be utilized in an apparatus that may be used to implement the methods described herein.

FIG. 20 illustrates various components that may be utilized in an apparatus 2001 that may be used to implement the various methods disclosed herein. The illustrated components may be located within the same physical structure or in separate housings or structures. Thus, the term apparatus 2001 is used to mean one or more broadly defined computing devices unless it is expressly stated otherwise. Computing devices include the broad range of digital computers including microcontrollers, hand-held computers, personal computers, servers, mainframes, supercomputers, minicomputers, workstations, and any variation or related device thereof.

The apparatus 2001 is shown with a processor 2003 and memory 2005. The processor 2003 may control the operation of the apparatus 2001 and may be embodied as a microprocessor, a microcontroller, a digital signal processor (DSP) or other device known in the art. The processor 2003 typically performs logical and arithmetic operations based on program instructions stored within the memory 2005. The instructions in the memory 2005 may be executable to implement the methods described herein.

The apparatus 2001 may also include one or more communication interfaces 2007 and/or network interfaces 2013 for communicating with other electronic devices. The communication interface(s) 2007 and the network interface(s) 2013 may be based on wired communication technology, wireless communication technology, or both.

The apparatus 2001 may also include one or more input devices 2009 and one or more output devices 2011. The input devices 2009 and output devices 2011 may facilitate user input. Other components 2015 may also be provided as part of the apparatus 2001.

FIG. 20 illustrates one possible configuration of an apparatus 2001. Various other architectures and components may be utilized.

As used herein, the term "determining" (and grammatical variants thereof) is used in an extremely broad sense. The term "determining" encompasses a wide variety of actions and, therefore, "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

Information and signals may be represented using any of a variety of different technologies and techniques. For example, data, instructions, commands, information, signals and the like that may be referenced throughout the above description may be represented by voltages, currents, electromagnetic waves, magnetic fields or particles, optical fields or particles or any combination thereof.

The various illustrative logical blocks, modules and circuits described in connection with the present disclosure may be implemented or performed with a general purpose processor, a digital signal processor (DSP), an application specific integrated circuit (ASIC), a field programmable gate array signal (FPGA) or other programmable logic device, discrete gate or transistor logic, discrete hardware components or any combination thereof designed to perform the functions described herein. A general purpose processor may be a microprocessor, but in the alternative, the processor may be any commercially available processor, controller, microcontroller or state machine. A processor may also be implemented as a combination of computing devices, e.g., a combination of a DSP and a microprocessor, a plurality of microprocessors, one or more microprocessors in conjunction with a DSP core or any other such configuration.

The steps of a method or algorithm described in connection with the present disclosure may be embodied directly in hardware, in a software module executed by a processor or in a combination of the two. A software module may reside in any form of storage medium that is known in the art. Some examples of storage media that may be used include RAM memory, flash memory, ROM memory, EPROM memory, EEPROM memory, registers, a hard disk, a removable disk, a CD-ROM and so forth. A software module may comprise a single instruction, or many instructions, and may be distributed over several different code segments, among different programs and across multiple storage media. A storage medium may be coupled to a processor such that the processor can read information from, and write information to, the storage medium. In the alternative, the storage medium may be integral to the processor.

The methods disclosed herein comprise one or more steps or actions for achieving the described method. The method steps and/or actions may be interchanged with one another without departing from the scope of the claims. In other words, unless a specific order of steps or actions is specified, the order and/or use of specific steps and/or actions may be modified without departing from the scope of the claims.

The functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media.

It is to be understood that the claims are not limited to the precise configuration and components illustrated above. Various modifications, changes and variations may be made in the arrangement, operation and details of the methods and apparatus described above without departing from the scope of the claims.

What is claimed is:

1. A method for providing an interface to a processing engine that utilizes intelligent audio mixing techniques, comprising:

triggering by event a request to change a perceptual location of an audio source within an audio mixture from a current perceptual location relative to a listener to a new perceptual location relative to the listener, wherein the audio mixture comprises at least two audio sources, wherein the request comprises a perceptual angle of the new perceptual location, wherein the request further comprises a defined duration that is desired for transitioning to the new perceptual location;

generating one or more control signals that are configured to cause the processing engine to change the perceptual location of the audio source from the current perceptual location to the new perceptual location via separate foreground processing and background processing, wherein the separate processing comprises processing a foreground signal differently than a background signal; and providing the one or more control signals to the processing engine.

2. The method of claim 1, wherein separate foreground processing and background processing further comprises:

splitting an input audio source into the foreground signal and the background signal.

3. The method of claim 2, wherein the background processing comprises processing the background signal to sound more diffuse than the foreground signal.

4. The method of claim 1, wherein the one or more control signals cause the processing engine to gradually change the perceptual location of the audio source from the current perceptual location to the new perceptual location.

5. The method of claim 1, further comprising determining new values for parameters of the processing engine, wherein the new values correspond to the new perceptual location, and wherein the one or more control signals comprise commands for setting the parameters to the new values.

6. The method of claim 1, wherein changing from the current perceptual location to the new perceptual location comprises a transition within a foreground region relative to the listener, and further comprising determining new values for parameters of a foreground angle control component of the processing engine.

7. The method of claim 1, wherein changing from the current perceptual location to the new perceptual location comprises a transition within a background region relative to the listener, and further comprising determining new values for parameters of a background angle control component of the processing engine.

8. The method of claim 1, wherein changing from the current perceptual location to the new perceptual location comprises a transition from a background region relative to the listener to a foreground region relative to the listener, and further comprising determining new values for parameters of a foreground angle control component of the processing engine, a foreground attenuation component of the processing engine, and a background attenuation component of the processing engine.

9. The method of claim 1, wherein changing from the current perceptual location to the new perceptual location comprises a transition from a foreground region relative to the listener to a background region relative to the listener, and further comprising determining new values for parameters of a background angle control component of the processing engine, a background attenuation component of the processing engine, and a foreground attenuation component of the processing engine.

10. An apparatus for providing an interface to a processing engine that utilizes intelligent audio mixing techniques, comprising:

a processor;

memory in electronic communication with the processor;

instructions stored in the memory, the instructions being executable to:

trigger by event a request to change a perceptual location of an audio source within an audio mixture from a current perceptual location relative to a listener to a new perceptual location relative to the listener, wherein the audio mixture comprises at least two audio sources, wherein the request comprises a perceptual angle of the new perceptual location, wherein the request further comprises a defined duration that is desired for transitioning to the new perceptual location;

generate one or more control signals that are configured to cause the processing engine to change the perceptual location of the audio source from the current perceptual location to the new perceptual location via separate foreground processing and background processing, wherein the separate processing comprises processing a foreground signal differently than a background signal; and provide the one or more control signals to the processing engine.

11. The apparatus of claim 10, wherein separate foreground processing and background processing further comprises:

splitting an input audio source into the foreground signal and the background signal.

12. The apparatus of claim 11, wherein the background processing comprises processing the background signal to sound more diffuse than the foreground signal.

13. The apparatus of claim 10, wherein the one or more control signals cause the processing engine to gradually change the perceptual location of the audio source from the current perceptual location to the new perceptual location.

14. The apparatus of claim 10, wherein the instructions are also executable to determine new values for parameters of the processing engine, wherein the new values correspond to the new perceptual location, and wherein the one or more control signals comprise commands for setting the parameters to the new values.

15. The apparatus of claim 10, wherein changing from the current perceptual location to the new perceptual location comprises a transition within a foreground region relative to the listener, and wherein the instructions are also executable to determine new values for parameters of a foreground angle control component of the processing engine.

16. The apparatus of claim 10, wherein changing from the current perceptual location to the new perceptual location comprises a transition within a background region relative to the listener, and wherein the instructions are also executable to determine new values for parameters of a background angle control component of the processing engine.

17. The apparatus of claim 10, wherein changing from the current perceptual location to the new perceptual location comprises a transition from a background region relative to the listener to a foreground region relative to the listener, and wherein the instructions are also executable to determine new values for parameters of a foreground angle control component of the processing engine, a foreground attenuation component of the processing engine, and a background attenuation component of the processing engine.

18. The apparatus of claim 10, wherein changing from the current perceptual location to the new perceptual location comprises a transition from a foreground region relative to the listener to a background region relative to the listener, and wherein the instructions are also executable to determine new values for parameters of a background angle control component of the processing engine, a background attenuation component of the processing engine, and a foreground attenuation component of the processing engine.

19. A non-transitory computer-readable medium comprising instructions providing an interface to a processing engine that utilizes audio mixing techniques on a mobile device, which when executed by a processor causes the processor to trigger by event a request to change a perceptual location of an audio source within an audio mixture from a current perceptual location relative to a listener to a new perceptual location relative to the listener, wherein the audio mixture comprises at least two audio sources, wherein the request comprises a perceptual angle of the new perceptual location, wherein the request further comprises a defined duration that is desired for transitioning to the new perceptual location;

generate one or more control signals that are configured to cause the processing engine to change the perceptual location of the audio source from the current perceptual location to the new perceptual location via separate foreground processing and background processing, wherein the separate processing comprises processing a foreground signal differently than a background signal; and provide the one or more control signals to the processing engine.

20. The computer-readable medium of claim 19, wherein separate foreground processing and background processing further comprises:

splitting an input audio source into the foreground signal and the background signal.

21. The computer-readable medium of claim 20, wherein the background processing comprises processing the background signal to sound more diffuse than the foreground signal.

22. The computer-readable medium of claim 19, wherein the one or more control signals cause the processing engine to gradually change the perceptual location of the audio source from the current perceptual location to the new perceptual location.

23. The computer-readable medium of claim 19, wherein the instructions also cause the processor to determine new values for parameters of the processing engine, wherein the new values correspond to the new perceptual location, and wherein the one or more control signals comprise commands for setting the parameters to the new values.

24. The computer-readable medium of claim 19, wherein changing from the current perceptual location to the new perceptual location comprises a transition within a foreground region relative to the listener, and wherein the instructions also cause the processor to determine new values for parameters of a foreground angle control component of the processing engine.

25. The computer-readable medium of claim 19, wherein changing from the current perceptual location to the new perceptual location comprises a transition within a background region relative to the listener, and wherein the instructions also cause the processor to determine new values for parameters of a background angle control component of the processing engine.

26. The computer-readable medium of claim 19, wherein changing from the current perceptual location to the new perceptual location comprises a transition from a background region relative to the listener to a foreground region relative to the listener, and wherein the instructions also cause the processor to determine new values for parameters of a foreground angle control component of the processing engine, a foreground attenuation component of the processing engine, and a background attenuation component of the processing engine.

27. The computer-readable medium of claim 19, wherein changing from the current perceptual location to the new perceptual location comprises a transition from a foreground region relative to the listener to a background region relative to the listener, and wherein the instructions also cause the processor to determine new values for parameters of a background angle control component of the processing engine, a background attenuation component of the processing engine, and a foreground attenuation component of the processing engine.

28. An apparatus for providing an interface to a processing engine that utilizes intelligent audio mixing techniques, comprising:

means for triggering by event a request to change a perceptual location of an audio source within an audio mixture from a current perceptual location relative to a listener to a new perceptual location relative to the listener, wherein the audio mixture comprises at least two audio sources, wherein the request comprises a perceptual angle of the new perceptual location, wherein the request further comprises a defined duration that is desired for transitioning to the new perceptual location;

means for generating one or more control signals that are configured to cause the processing engine to change the perceptual location of the audio source from the current perceptual location to the new perceptual location via separate foreground processing and background processing, wherein the separate processing comprises processing a foreground signal differently than a background signal; and means for providing the one or more control signals to the processing engine.

29. The apparatus of claim 28, wherein separate foreground processing and background processing further comprises:

splitting an input audio source into the foreground signal and the background signal.

30. The apparatus of claim 29, wherein the background processing comprises processing the background signal to sound more diffuse than the foreground signal.

31. The apparatus of claim 28, wherein the one or more control signals cause the processing engine to gradually change the perceptual location of the audio source from the current perceptual location to the new perceptual location.

32. The apparatus of claim 28, further comprising determining new values for parameters of the processing engine, wherein the new values correspond to the new perceptual location, and wherein the one or more control signals comprise commands for setting the parameters to the new values.

33. The apparatus of claim 28, wherein changing from the current perceptual location to the new perceptual location comprises a transition within a foreground region relative to the listener, and further comprising means for determining new values for parameters of a foreground angle control component of the processing engine.

34. The apparatus of claim 28, wherein changing from the current perceptual location to the new perceptual location comprises a transition within a background region relative to the listener, and further comprising means for determining new values for parameters of a background angle control component of the processing engine.

35. The apparatus of claim 28, wherein changing from the current perceptual location to the new perceptual location comprises a transition from a background region relative to the listener to a foreground region relative to the listener, and further comprising means for determining new values for parameters of a foreground angle control component of the processing engine, a foreground attenuation component of the processing engine, and a background attenuation component of the processing engine.

36. The apparatus of claim 28, wherein changing from the current perceptual location to the new perceptual location comprises a transition from a foreground region relative to the listener to a background region relative to the listener, and further comprising means for determining new values for parameters of a background angle control component of the processing engine, a background attenuation component of the processing engine, and a foreground attenuation component of the processing engine.

* * * * *